US010597991B2

(12) United States Patent
Lopez

(10) Patent No.: US 10,597,991 B2
(45) Date of Patent: Mar. 24, 2020

(54) CONTROL SYSTEMS FOR FRACTURING OPERATIONS

(71) Applicant: SCHLUMBERGER TECHNOLOGY CORPORATION, Sugar Land, TX (US)

(72) Inventor: Miguel Angel Lopez, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 561 days.

(21) Appl. No.: 14/513,020

(22) Filed: Oct. 13, 2014

(65) Prior Publication Data

US 2016/0102537 A1 Apr. 14, 2016

(51) Int. Cl.

| | |
|---|---|
| ***E21B 43/26*** | (2006.01) |
| ***G05B 15/02*** | (2006.01) |
| ***E21B 47/00*** | (2012.01) |
| ***E21B 47/06*** | (2012.01) |
| ***E21B 34/02*** | (2006.01) |
| ***E21B 34/16*** | (2006.01) |

(52) U.S. Cl.
CPC ..... *E21B 43/26* (2013.01)

(58) Field of Classification Search
CPC ..... G05B 15/02; E21B 43/26
See application file for complete search history.

(56) References Cited

U.S. PATENT DOCUMENTS

| | | | | |
|---|---|---|---|---|
| 3,811,321 | A * | 5/1974 | Urbanosky | E21B 49/10 73/152.25 |
| 6,047,239 | A * | 4/2000 | Berger | E21B 21/103 702/12 |
| 6,157,893 | A * | 12/2000 | Berger | E21B 49/008 702/12 |
| 7,464,770 | B2 * | 12/2008 | Jones | E21B 7/062 175/24 |
| 7,627,397 | B2 | 12/2009 | Parraga | |
| 7,845,413 | B2 | 12/2010 | Shampine et al. | |
| 7,967,081 | B2 * | 6/2011 | Sugiura | E21B 7/062 175/24 |
| 8,118,114 | B2 * | 2/2012 | Sugiura | E21B 7/062 175/24 |
| 8,151,885 | B2 | 4/2012 | Bull et al. | |
| 2009/0090504 | A1 * | 4/2009 | Weightman | E21B 43/26 166/250.01 |

(Continued)

*Primary Examiner* — Charles R Kasenge
(74) *Attorney, Agent, or Firm* — Cathy Hewitt

(57) ABSTRACT

A system can include a low pressure manifold that includes an inlet and a plurality of outlets and a high pressure manifold that comprises a plurality of inlets and an outlet. The system can include a flow path that comprises one of the outlets of the low pressure manifold and one of the inlets of the high pressure manifold. The system can further include a pump that includes a portion of the flow path and a valve coupled with one of the low pressure manifold and the high pressure manifold. The system can further include a control system coupled with the valve and the pump, and the control system can include a processor that is configured to make a determination of whether the valve is in fluid communication with the flow path and control at least one of the valve and the pump based on the determination.

50 Claims, 19 Drawing Sheets

(56) References Cited

U.S. PATENT DOCUMENTS

| | | | | |
|---|---|---|---|---|
| 2009/0157329 | A1* | 6/2009 | Weightman | G01F 1/58 702/25 |
| 2010/0154894 | A1* | 6/2010 | Kotapish | F16K 17/10 137/14 |
| 2011/0272158 | A1 | 11/2011 | Neal | |
| 2012/0018147 | A1* | 1/2012 | Niconoff | E21B 49/10 166/250.01 |
| 2012/0060929 | A1* | 3/2012 | Kendrick | E21B 21/062 137/1 |
| 2012/0280488 | A1* | 11/2012 | Pionetti | B05D 1/002 285/55 |
| 2013/0284455 | A1* | 10/2013 | Kajaria | E21B 43/26 166/379 |
| 2014/0048255 | A1* | 2/2014 | Baca | E21B 33/068 166/250.1 |
| 2014/0277772 | A1 | 9/2014 | Lopez et al. | |
| 2015/0000753 | A1* | 1/2015 | Ramirez | F17D 1/00 137/12 |
| 2015/0153314 | A1 | 6/2015 | Karoum et al. | |
| 2015/0176347 | A1* | 6/2015 | Bansal | E21B 17/01 166/341 |

* cited by examiner

CONTROL SYSTEMS FOR FRACTURING OPERATIONS

BACKGROUND

Hydraulic fracturing is one of various oilfield operations used to extract products from underground formations. In hydraulic fracturing, a fluid is generally pumped down a wellbore at one or more of a pressure or flow rate sufficient to fracture a subterranean formation. After the fracture is created or, in some instances, in conjunction with the creation of the fracture, proppant may be injected into the wellbore and into the fracture. The proppant can be a particulate material added to the pumped fluid to produce a slurry. The proppant can prevent the fracture from closing when pressure is released, which can provide improved flow of recoverable fluids (e.g., oil, gas, or water).

Some fracturing operations may use a manifold system, often referred to as a missile, which can be connected to multiple fracturing pumps. In some arrangements, the missile can receive a fracturing fluid at low pressure from a blender and can deliver the fracturing fluid to the fracturing pumps. The fracturing pumps can pressurize the fluid, which can be collected by the missile from the fracturing pumps and delivered into a wellbore. Certain embodiments disclosed herein can improve fracturing operations in which a missile is used.

SUMMARY

This summary introduces a selection of concepts that are described further in the detailed description below. This summary is not, however, intended to identify necessary or important features, nor should it be used to limit the scope of the claimed subject matter.

Generally, embodiments herein relate to apparatus and methods for a control system for hydraulic fracturing equipment by definition of variable inter-equipment flow connections. In some embodiments, a system can include a low pressure manifold that includes an inlet and a plurality of outlets and a high pressure manifold that comprises a plurality of inlets and an outlet. The system can include a flow path that comprises one of the outlets of the low pressure manifold and one of the inlets of the high pressure manifold. The system can further include a pump that includes a portion of the flow path and a valve coupled with one of the low pressure manifold and the high pressure manifold. The system can further include a control system coupled with the valve and the pump, and the control system can include a processor that is configured to make a determination of whether the valve is in fluid communication with the flow path and control at least one of the valve and the pump based on the determination.

In certain embodiments, a system for treating a subterranean formation can include a low pressure manifold that includes an inlet and a plurality of outlets. The system can further include a high pressure manifold that includes a plurality of inlets and an outlet. The system can include a valve coupled with one of (a) one of the plurality of outlets of the low pressure manifold and (b) one of the inlets of the high pressure manifold. The system can also include a control system coupled to the valve, and the control system can include a processor that is configured to make a determination of whether the valve is in fluid communication with a flow path that comprises a specific outlet of the low pressure manifold and a specific inlet of the high pressure manifold and is configured to control the valve based on the determination.

In some embodiments, a system for treating a subterranean formation includes a low pressure manifold that includes an inlet and an outlet. The system can include a high pressure manifold that includes an inlet and an outlet that is in fluid communication with a wellbore. The system can include a valve coupled with the inlet of the high pressure manifold and a pump that includes an inlet in fluid communication with the outlet of the low pressure manifold and an outlet in fluid communication with the inlet of the high pressure manifold. The system can include a control system that includes a processor that is coupled to the pump and to the valve. The processor can be configured to receive data representing the fluid communication between the outlet of the pump and the inlet of the high pressure manifold; receive data representing an operational state of the pump; and control the valve based on both the data representing the fluid communication between the outlet of the pump and the inlet of the high pressure manifold and the data representing the operational state of the pump.

In some embodiments, a control system can be for a manifold assembly for treating a subterranean formation that includes a low pressure manifold and a high pressure manifold. The system can include an actuator coupled to a valve that is coupled to one of an outlet of the low pressure manifold and an inlet of the high pressure manifold. The system can also include a sensor configured to obtain data that is representative of whether the valve is in fluid communication with a flow path extending between the low pressure manifold and the high pressure manifold. The system can further include a processor coupled to the actuator and the sensor. The processor can be configured to receive from the sensor the data representative of whether the valve is in fluid communication with the flow path and can be configured to control the actuator to effect control of the valve based on the data representative of whether the valve is in fluid communication with the flow path.

In some embodiments, a method can include making a determination via a processor as to whether a valve is in fluid communication with a flow path that extends between a low pressure manifold and a high pressure manifold, the low pressure manifold comprising an inlet and a plurality of outlets, the high pressure manifold comprising a plurality of inlets and an outlet. The method can include controlling the valve via the processor based on the determination.

BRIEF DESCRIPTION OF DRAWINGS

The written disclosure herein describes illustrative embodiments that are non-limiting and non-exhaustive. Reference is made to certain of such illustrative embodiments that are depicted in the figures, in which.

DETAILED DESCRIPTION

Certain hydraulic fracturing operations utilize a manifold system for delivering a high pressure fluid down a wellbore. The manifold system can include a low pressure manifold for receiving a fluid from a blender and for distributing the fluid to multiple fracturing pumps, which pressurize the fluid. The manifold system can further include a high pressure manifold for collecting the fluid from the fracturing pumps and for delivering the fluid downhole. The term "fluid," as used herein, includes liquids, slurries, gases, any other material that can suitably be pumped, or any suitable combination thereof.

A manifold system such as just described is often referred to as a missile. In some arrangements, the manifold system is connected to a chassis and can be transportable. For example, the manifold system can be mounted on a trailer, which is commonly referred to as a missile trailer or as a manifold trailer. In some arrangements, a manifold trailer includes a number of valves, such as for controlling flow relative to the pumps. The valves are manually opened or closed, and the fracturing pumps are manually connected to the manifold trailer.

In some arrangements, the fracturing pumps are independent units that can be plumbed to a manifold trailer at a job site of a fracturing operation. A particular pump might be hooked up to different portions of the manifold trailer at one job site as compared to a subsequent job site. A sufficient number of pumps can be connected to the manifold trailer to produce a desired volume and pressure output. For example, some fracturing jobs can have up to 36 pumps, each of which can be connected to distinct valves on the manifold trailer or multiple manifold trailers.

In some arrangements, manually connecting a fracturing pump to an outlet and an inlet of the manifold trailer can result in miscommunication between, for example, a pump operator and an outside supervisor who opens and closes valves on the manifold trailer. Such a miscommunication regarding associations between valves and pumps can result in the opening or closing of valves in undesired manners. For example, inadvertently closing a valve to which a pump is in fluid communication can cause a pump to pump against the closed valve and over-pressurize a line. As another example, inadvertently opening a valve to which no pump is coupled can result in an undesired exposure of pressurized fluid to the environment.

Certain embodiments disclosed herein can resolve or ameliorate one or more of the foregoing shortcomings of some hydraulic fracturing systems. Other advantages or desirable features of these or other embodiments will also be apparent from the disclosure that follows. Further, certain embodiments can be advantageously implemented with manifold systems that are less mobile, more permanent (e.g., configured for long-term or permanent positioning at a wellsite), or both, as compared with manifold trailers.

Figure 1:
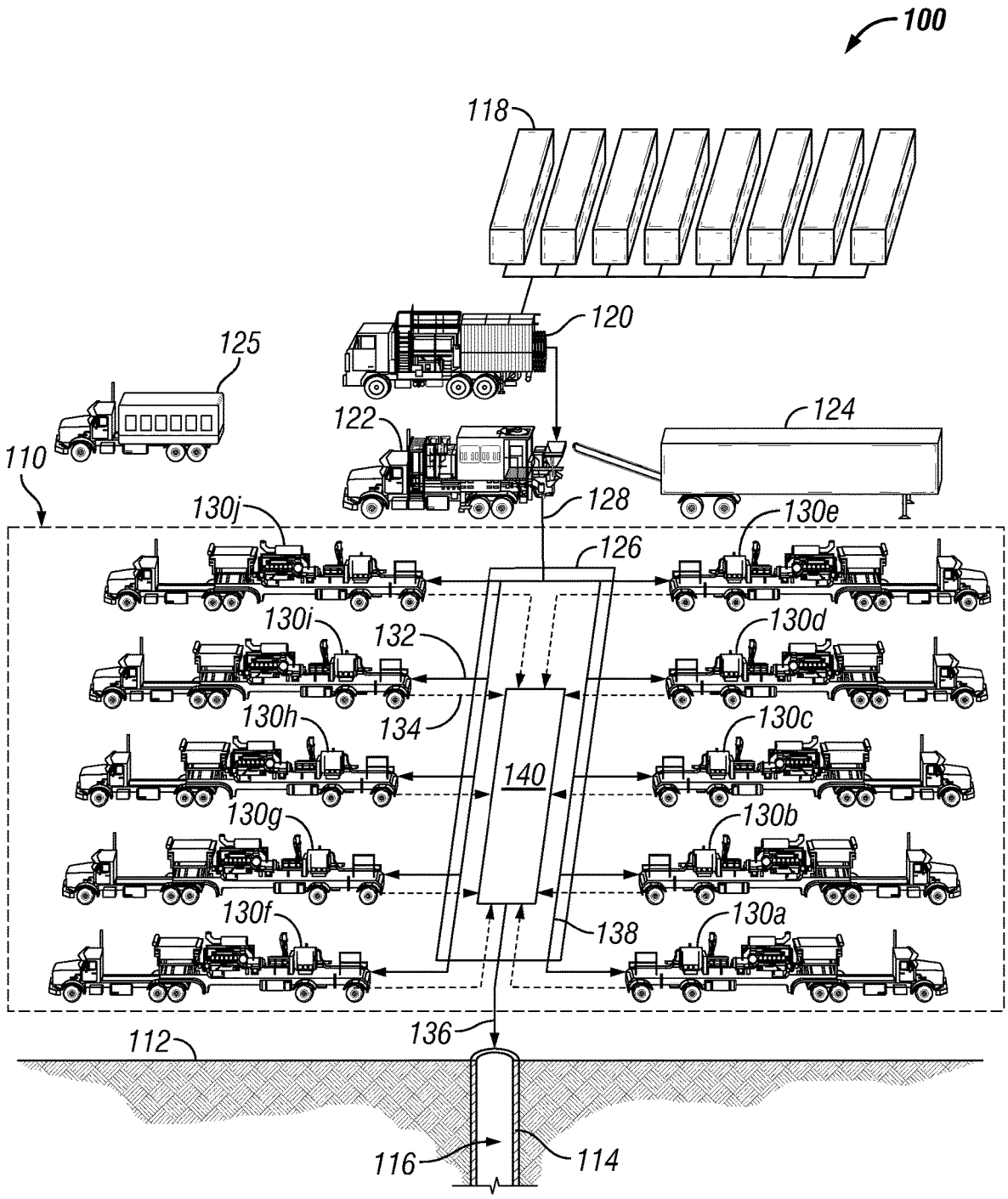
FIG. 1 is a perspective view of an embodiment of an oilfield operation in accordance with the present disclosure.

FIG. 1 depicts an example of a system 100 that can be used for a hydraulic fracturing operation, which may also be referred to as a job. The system 100 can include a pumping system 110 for pumping a fluid from a surface 112 of a well 114 to a well bore 116 during the oilfield operation. In the illustrated embodiment, the system 100 is being used for a hydraulic fracturing operation, and the fluid pumped is a fracturing fluid. For example, the fluid can be a slurry that includes a proppant. In the illustrated embodiment, the system 100 includes a plurality of water tanks 118 that feed water to a gel maker 120. The gel maker 120 combines water from the water tanks 118 with a gelling agent to form a gel. The gel is then sent to a blender 122 where it is mixed with a proppant from a proppant feeder 124 to form the fracturing fluid. A computerized control system 125 can be employed to direct at least a portion of the system 100 during at least a portion of a fracturing operation.

The fracturing fluid is pumped at low pressure (for example, within a range of from about 50 psi (345 kPa) to about 80 psi (552 kPa)) from the blender 122 to the pumping system 110 via one or more conduits, as depicted by a solid line 128. The pumping system 110 can include a common manifold system 126, which can also be referred to herein as a missile. In FIG. 1, the manifold system 126 is depicted schematically via an enlarged box having inbound and outbound arrows depicting various flow path segments. In the illustrated embodiment, the manifold system 126 includes a low pressure manifold 138 and a high pressure manifold 140. The low pressure manifold 138 of the manifold system 126 can distribute the low pressure slurry to a plurality of pumps 130 (i.e., pumps 130*a*-130*j*), as shown by solid lines 132. The pumps 130 can also be referred to as fracturing pumps, and may, for example, be plunger pumps. In the illustrated embodiment, each fracturing pump 130 receives the fracturing fluid at a low pressure and discharges it to the high pressure manifold 140 portion of the manifold system 126 at a high pressure, as shown by dashed lines 134 (for example, in various embodiments, the high pressure can be within a range of from about 3,000 psi (20.7 MPa) to about 15,000 psi (103 MPa)). The high pressure manifold 140 then directs the fracturing fluid from the pumps 130 to the well bore 116 as shown by solid line 136. Stated otherwise, an outlet of the high pressure manifold 140 can be in fluid communication with the well bore 116, and can be configured to deliver a fluid down the well bore.

The manifold system 126 can include a plurality of valves (which are not shown in FIG. 1, but are depicted with respect to other embodiments) that can be connected to the fracturing pumps 130, as discussed further below. The control system 125 can be used to automate the valves, as also discussed below. For example, the control system 125 can be configured to execute machine-readable code to control movement of the valves. In some arrangements, the control system 125 can automatically pair the valves with the pumps 130. For example, the control system 125 can create a flow path definition that is representative of various flow paths between separate portions of the manifold system 126. Based on the flow path definition, the control system 125 can create interlocks between the pumps 130 and the manifold system 126.

In some embodiments, fracturing pumps 130 can be independent units that are plumbed to the manifold system 126 onsite. In some arrangements, after the completion of a job, the fracturing pumps 130 can be disconnected from the manifold system 126, transported to another site, and connected to a manifold system at the new site. A particular fracturing pump 130 can be connected differently to the same manifold system 126 or to different manifold systems on different jobs. In some embodiments, each fracturing pump 130 can include a pump unit mounted on a truck or trailer for ease of transportation. Other arrangements are also possible. For example, the pump 130 can be mounted to a skid or any other suitable frame or platform, such as can be used for longer term operations.

In some embodiments, a pump 130 can include a prime mover that drives a crankshaft through a transmission and a drive shaft. The crankshaft, in turn, can drive one or more plungers toward and away from a chamber in the pump fluid end in order to create pressure oscillations of high and low pressure in the chamber. These pressure oscillations can allow the pump to receive a fluid at a low pressure and discharge it at a high pressure, such as via check valves. In some embodiments, a fluid end of a pump 130 can include an inlet (e.g., intake pipe) for receiving fluid at a low pressure from the manifold system 126 and an outlet (e.g., discharge pipe) for discharging fluid at a high pressure to the manifold system 126.

Figure 2:
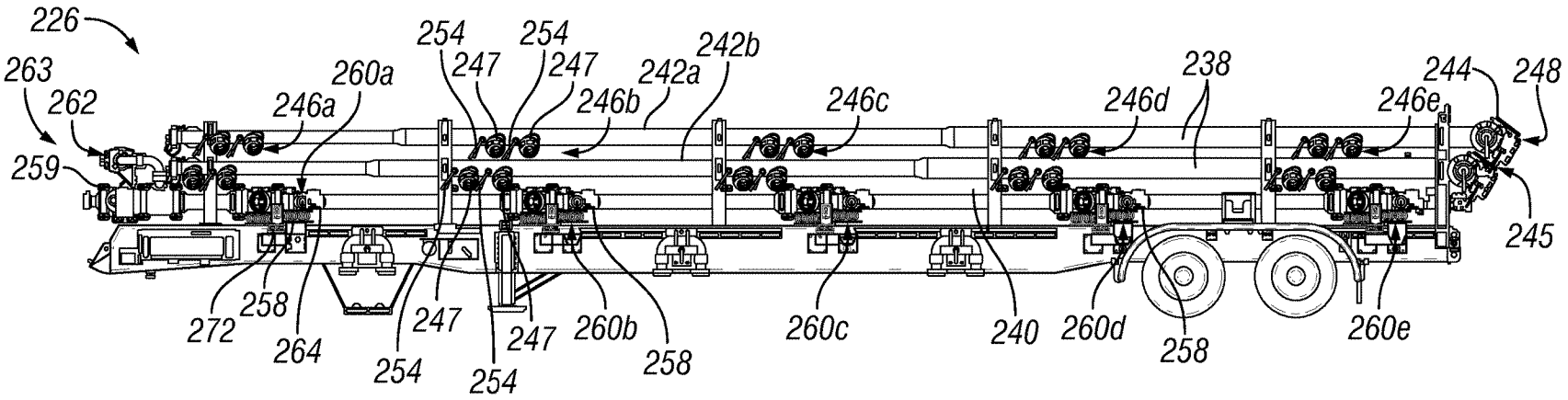
FIG. 2 is a side elevational view of an embodiment of a manifold trailer in accordance with the present disclosure.
Figure 3:
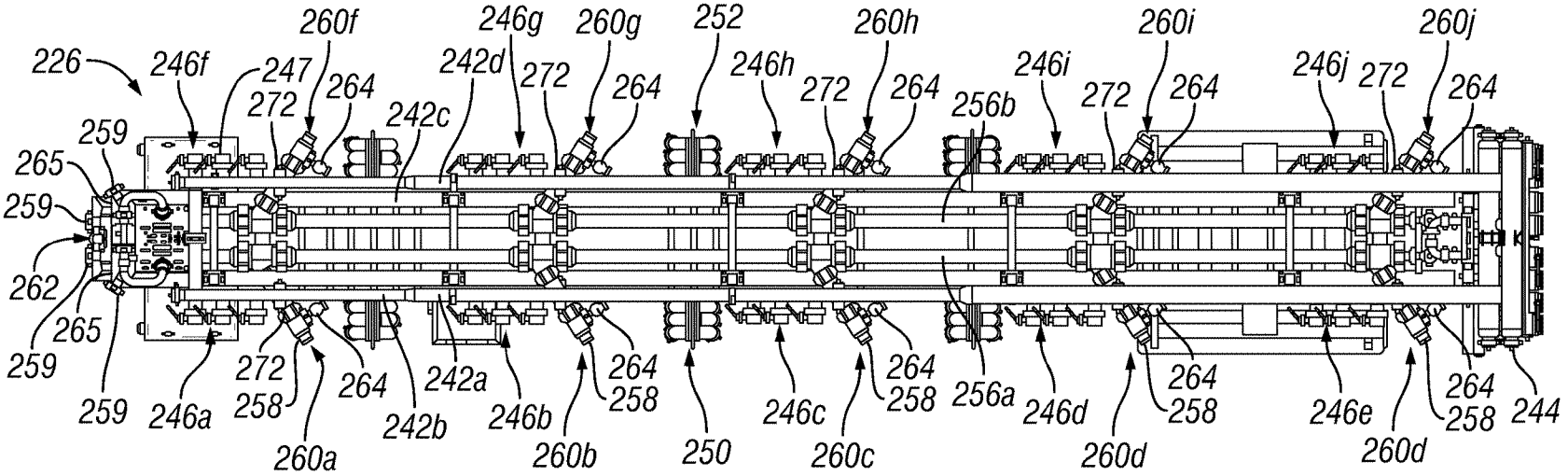
FIG. 3 is a top plan view of the manifold trailer of FIG. 2.
Figure 4:
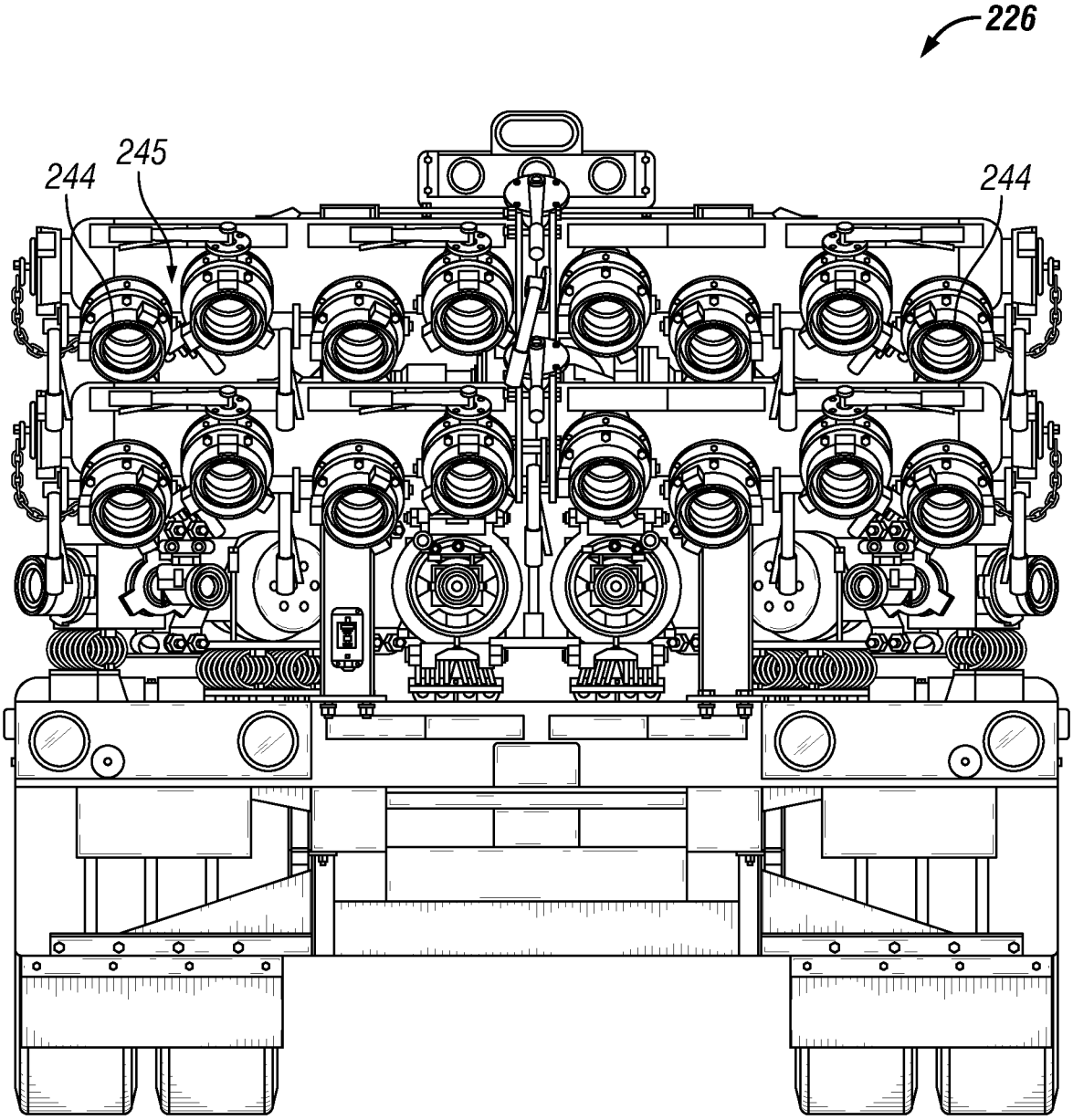
FIG. 4 is a rear elevational view of the manifold trailer of FIG. 2.

FIGS. 2-4 depict an embodiment of a manifold system 226 that is compatible with the system 100 described above. For example, the manifold system 226 can be used in the place of the manifold system 126 depicted in FIG. 1. The manifold system 226 can be configured to receive a low pressure fluid, such as a slurry, from the blender 122 and distribute the slurry to the plurality of fracturing pumps 130. The manifold system 226 can further collect high pressure slurry from the fracturing pumps 130 to deliver the slurry to the well bore 116. The manifold system 226 can include a low pressure manifold 238 that includes a one or more inlets 244 and a plurality of outlets 247. As discussed below, the inlets 244 can be placed in fluid communication with the blender 122 and the outlets 247 can be placed in fluid communication with inlets of the fracturing pumps 130. The manifold system 226 can further include a high pressure manifold 240, which can include a plurality of inlets 258 and one or more outlets 259. The plurality of inlets 258 can be placed in fluid communication with the outlets of the fracturing pumps 130. The outlets 259 of the high pressure manifold 240 can be placed in fluid communication with the well bore 116. In operation, the low pressure manifold 238 can receive a slurry from the blender 122 and distribute the slurry to the pumps 130 at a low pressure. The pumps 130 can pressurize the slurry and deliver it to the high pressure manifold 240, which can distribute the slurry to a subterranean formation, which can be in fluid communication with a portion of the well bore 116.

The low pressure manifold 238 can include one or more conduits 242*a*-242*d* (e.g., pipes). The inlets 244 can be coupled to the conduits 242*a*-242*d* in any suitable manner. In the illustrated embodiment, the low pressure manifold 238 includes four conduits 242*a*-242*d*, and each pipe is in fluid communication with four separate inlets 244. The inlets 244 may be located at a blender station 245 that is used to control fluid communication between the blender 122 and the low pressure manifold 238. In the illustrated embodiment, as shown in FIGS. 2 and 4, the blender station 245 can be located at a first end 248 of the manifold system 226.

The low pressure manifold 238 can include one or more low pressure stations 246*a*-246*j* for controlling fluid communication between the low pressure manifold 238 and the fracturing pumps 130*a*-130*j*. In the illustrated embodiment, each low pressure station 246*a*-246*j* includes four outlets 247. Further, in the illustrated embodiment, for each low pressure station 246*a*-246*j*, two of the outlets 247 are coupled to one of the four conduits 242*a*-242*d* and the remaining two outlets 247 are coupled to another of the four conduits 242*a*-242*d*. Stated otherwise, each low pressure station 246*a*-246*j* includes outlets 247 from two of the conduits 242*a*-242*d* (i.e., either the conduits 242*a*, 242*b* or the conduits 242*c*, 242*d*). In various embodiments, each outlet 247 can have any suitable connection arrangement. For example, an outlet 247 can be configured to couple with any suitable conduit (not shown in FIGS. 2-4) for providing fluid communication between the low pressure manifold 238 and a pump 130. In some arrangements, the conduit can comprise any suitable tubing, such as a hose.

As depicted in FIG. 3, in the illustrated embodiment, the low pressure stations 246*a*-246*e* are at a first side 250 of the manifold system 226 and the low pressure stations 246*f*-246*j* are at an opposite side 252 of the manifold system 226. With reference again to FIG. 1, in some arrangements, the low pressure stations 246*a*-246*e* can be coupled with the pumps 130*a*-130*e*, and the low pressure stations 246*f*-246*j* can be coupled with the pumps 130*f*-130*j*, respectively.

As shown in FIG. 2, in the illustrated embodiment, each of the outlets 247 of the low pressure stations 246*a*-246*j* can be coupled with a separate valve 254. The valves 254 may be of any suitable variety. In some embodiments, the valves are isolation valves. The valves 254 may be configured to either permit or prevent fluid communication between the low pressure manifold 238 and conduits coupled with the outlets 247. For example, the valves 254 may be configured to either permit or prevent fluid communication between the low pressure manifold 238 and the pumps 130. For outlets 247 that may not be coupled with any conduits or pumps, the associated valves 254 may prevent fluid communication between the low pressure manifold 238 and the environment.

Although each illustrated low pressure station 246 includes four outlets 247 and four associated valves 254, other arrangements are contemplated. For example, a single outlet/valve pairing is possible, or other numbers of such pairings are also possible. The single or multiple outlets and associated valves of a give low pressure station 246 may be coupled to the same pump 130.

As shown in FIG. 3, the high pressure manifold 240 can include one or more conduits 256*a*, 256*b* (e.g., pipes) and one or more high pressure stations 260*a*-260*j* for controlling fluid communication between the fracturing pumps 130 and the high pressure manifold 240. The high pressure stations 260*a*-260*j* can each include an inlet 258 for coupling the pumps 130 to the conduits 256*a*, 256*b*. In various embodiments, each inlet 258 can have any suitable connection arrangement. For example, an inlet 258 can be configured to couple with any suitable conduit for providing fluid communication between the high pressure manifold 240 and a pump 130. In some arrangements, the conduit can comprise any suitable tubing, such as steel piping.

As shown in FIG. 3, the high pressure stations 260*a*-260*e* and 260*f*-260*j* can be located on the opposing sides 250 and 252 of the manifold assembly 262, respectively. With additional reference to FIG. 1, the high pressure stations 260*a*-260*e* can be in fluid communication with outlets of the pumps 130*a*-130*e* and the high pressure stations 260*f*-260*j* can be in fluid communication with outlets of the pumps 130*f*-130*j*.

In the illustrated embodiment, each of the inlets 258 of the high pressure manifold 240 is in fluid communication with a plug valve 272, which may also be referred to as an isolation valve, and is also in fluid communication with a high pressure bleed valve 264. The plug valve 272 can be configured to control the fluid communication between an inlet 258 and one of the fracturing pumps 130. The high pressure bleed valve 264 can be configured to hold pressure when in a closed position and can be configured to bleed pressure present at the inlet 258 when opened. As shown in FIG. 2, each of the high pressure stations 260*a*-260*e* is provided with a separate inlet 258, high pressure bleed valve 264, and plug valve 272.

The high pressure manifold 240 can include a well bore station 262 for controlling fluid communication with the well bore 116. As shown in FIGS. 2 and 3, the well bore station 262 can be located at an end 263 of the manifold system 226 that is opposite from the first end 248. The well bore station 262 can include one or more outlets 259 by which the high pressure manifold 240 can be connected with the well bore 116. Each of the outlets 259 can be coupled with a bleed valve 265, in some embodiments.

In operation, the high pressure manifold 240 can receive slurry from the fracturing pumps 130 at each high pressure station 260 that is connected to a pump. The high pressure manifold 240 can deliver the high pressure slurry to the well bore 116 via one or more of the outlets 259.

Any suitable arrangement of the manifold system 226 is contemplated. For example, in the illustrated embodiment, the low pressure manifold 238 and the high pressure manifold 240 are shown mounted to a trailer. Such an arrangement can be useful for frequently moving the manifold system 226. In other embodiments, the manifold system 226 may be mounted to any suitable structure or frame. For example, the manifold system 226 can be mounted to a skid, which may be positioned on a ship. In other embodiments, the manifold system 226 can be mounted to frame that is positioned in either a temporary or permanent manner at a well site. Stated otherwise, the manifold system 226 can be configured for longer term positioning at a site.

In certain embodiments, the low pressure manifold 238 may be provided as two low pressure manifolds 238, along with the high pressure manifold 240. The two low pressure manifolds 238 may be used for split stream operations such as described in U.S. Pat. No. 7,845,413 which is hereby incorporated by reference.

Figure 5A:
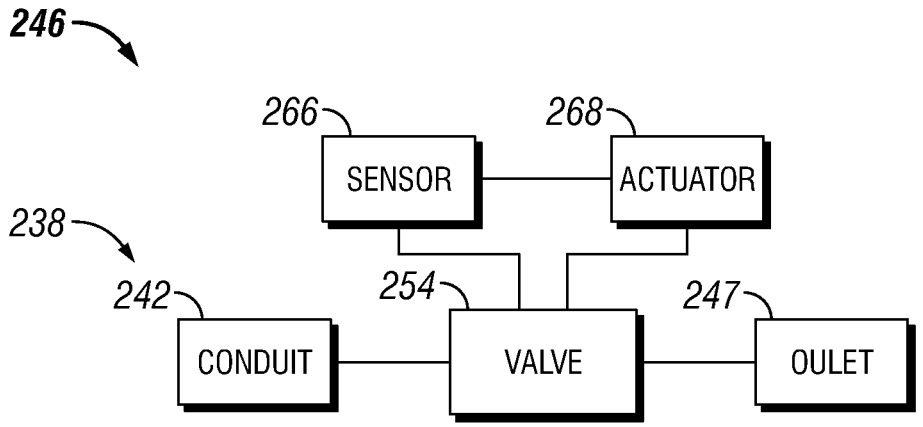
FIG. 5A is a block diagram of one embodiment of a low pressure station in accordance with the present disclosure.

FIG. 5A schematically depicts a low pressure station 246, such as any of the low pressure stations 246*a*-246*j* of the manifold system 226. The low pressure station 246 includes a low pressure valve 254 that is configured to selectively permit and selectively prevent fluid communication between a conduit 242 of the low pressure manifold 238 and a specific outlet 247 of the low pressure manifold 238. The low pressure valve 254 can be coupled with a position sensor 266 in any suitable manner. The position sensor 266 can detect a position of the low pressure valve 254. In other or further embodiments, the position sensor 266 can detect a position of and/or an operational state of an actuator 268, which can be coupled with the low pressure valve 254 in any suitable manner. The actuator 268 can be configured to selectively open and selectively close the valve 254. Stated otherwise, the actuator 268 can be configured to change the position of the low pressure valve 254 in any suitable manner. In some embodiments, the actuator 268 is connected to the position sensor 266. For example, the position sensor 266 and the actuator 268 can be electrically connected together.

In the illustrated embodiment, various connections among the valve 254, the position sensor 266, and the actuator 268 are depicted via solid lines. Such connections may be direct connections of any suitable variety, such as electrical connections. In the illustrated embodiment, the position sensor 266 is directly coupled with the low pressure valve 254 and is also directly coupled with the actuator 268; moreover, the actuator 268 is directly coupled with the low pressure valve 254. Other connections are possible. For example, in some embodiments, the position sensor 266 is coupled directly to the actuator 268 and the actuator 268 is directly coupled to the low pressure valve 254; however, the position sensor 266 is not directly coupled to the low pressure valve 254.

In some embodiments, the position sensor 266 may directly detect a position of the valve 254. In other embodiments, the position sensor 266 may indirectly detect a position of the valve 254, such as by detecting an actuation state of the actuator 268 (e.g., whether the actuator 254 has most recently been used to open or close the valve 254), rather than directly detecting the position of the valve 254. In still other or further embodiments, the position sensor 266 may be omitted and a position of the valve 254 may be determined from the actuation state of the actuator 268.

In some embodiments, the position sensor 266 and the actuator 268 are connected to a computer system 270 (see FIG. 7) in any suitable manner, such as via a wired or a wireless connection. The computer system 270 may be located at any suitable position. For example, the computer system 270 may be positioned on the manifold system 226 (e.g., the computer system 270 may be mounted on a chassis or other structure of the manifold system 226), in some embodiments, and may be configured to communicate with the computerized control system 125 in any suitable manner, such as via a wired or wireless connection. In other embodiments, the computer system 270 may be integrally formed with the control system 125 (e.g., may be positioned within the control system 125). In either case, it may be said that the control system 125 includes the computer system 270 and/or that the computer system 270 is itself a control system. The computer system 270 can obtain information regarding a position of the low pressure valve 254, e.g., whether the valve 254 is in an open or a closed position, from the position sensor 266. In other or further embodiments, the computer system 270 can cause the position sensor 266 to detect the position of the valve 254. The computer system 270 may, based on the position of the low pressure valve 254, cause the actuator 268 to move the low pressure valve 254, for example to open or close the low pressure valve 254.

The position sensor 266 can be any suitable sensor, e.g., electrical or mechanical, and may provide any suitable signal, e.g., analog or digital, which can be interpreted by the computer system 270 to identify a current position of the low pressure valve 254. The actuator 268 can comprise any suitable motor, hydraulic device, pneumatic device, electrical device, or other similar mechanical or digital device capable of receiving input from the computer system 270 and causing the low pressure valve 254 to move in accordance with the input of the computer system 270 and/or the position sensor 266. It will be understood in view of the present disclosure that, in some embodiments, each of the low pressure stations 246 can have multiple outlets 247 and low pressure valves 254, such as described above with respect to FIGS. 2 and 3. Each such valve 254 can include its own position sensor 266 and actuator 268.

Figure 5B:
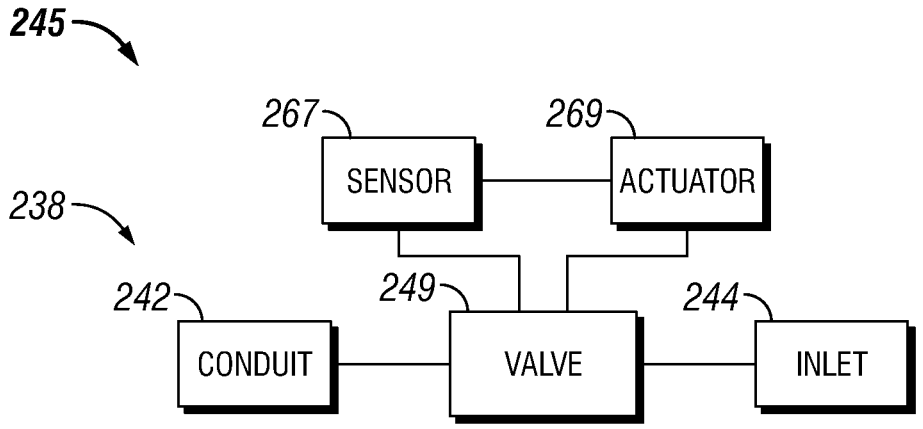
FIG. 5B is a block diagram of one embodiment of a blender station in accordance with the present disclosure.
Figure 7:
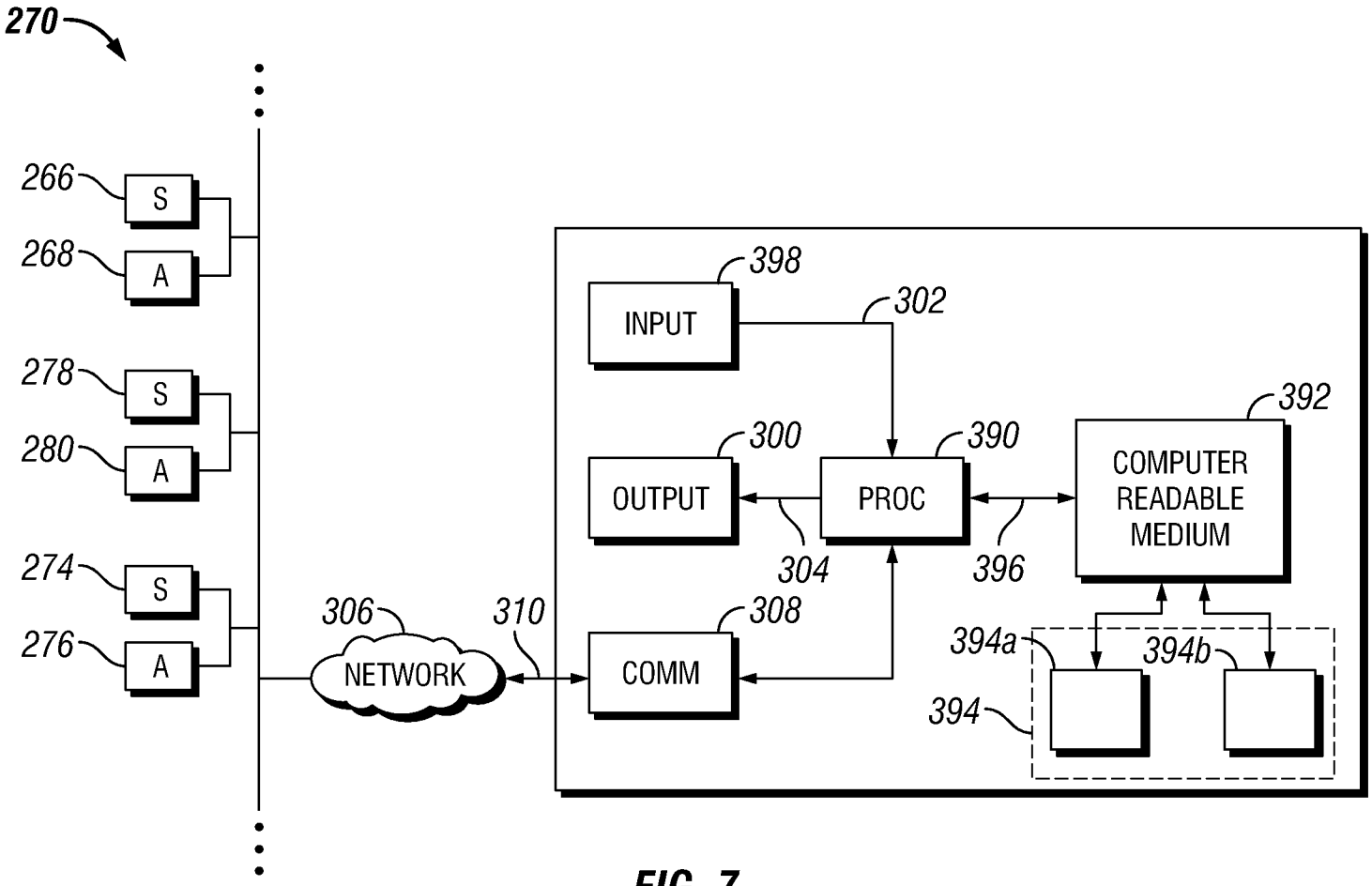
FIG. 7 is a schematic view of an embodiment of a computer system in accordance with the present disclosure.

As shown in FIG. 5B, the blender station 245 can be implemented similarly or the same as described with respect to the low pressure station 246 of FIG. 5A. For example, a blender station 245 can include a valve 249 that is configured to permit selective communication between an inlet 244 and a conduit 242 of the low pressure manifold 238. The valve 249 can be coupled with a position sensor 267 and an actuator 269, which can function in manners such as described above with respect to the position sensor 266 and the actuator 268. As shown in FIG. 7, in some embodiments, the position sensor 267 and the actuator 269 can be coupled with the computer system 270.

Figure 6:
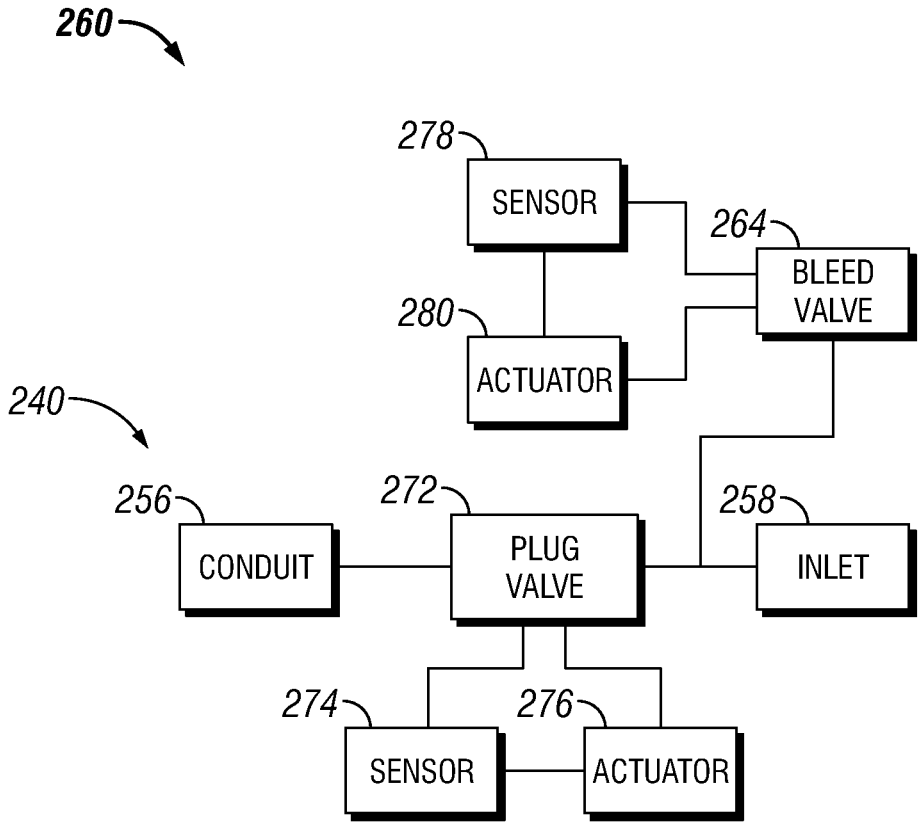
FIG. 6 is a block diagram of one embodiment of a high pressure station in accordance with the present disclosure.

Referring now to FIG. 6, at each high pressure station 260, the high pressure manifold 240 can be provided with a plug valve 272 to selectively prevent or allow fluid transmission into a conduit 256 of the high pressure manifold 240 from an inlet 258. The plug valve 272 can be coupled with a position sensor 274 to detect a position of the plug valve 272. The plug valve 272 can be coupled with an actuator 276 that is configured to change the position of the plug valve 272. In some embodiments, the actuator 276 can be connected to the position sensor 274, such as via an electrical connection. The actuator 276 and the position sensor 274 can be the same as and/or operate in manners such as described above with respect to the actuator 268 and the position sensor 266.

The high pressure station 260 can further include a bleed valve 264, which can draw pressure from a position between the plug valve 272 and the inlet 258. The bleed valve 264 may be selectively opened and closed. In the illustrated embodiment, the bleed valve 264 is coupled with a position sensor 278 and is coupled with an actuator 280. As with other position sensors and actuators described above, in some embodiments, the actuator 280 can be connected to the high pressure bleed valve 264 and the position sensor 278. The actuator 280 can be configured to change the position of the high pressure bleed valve 264. As shown in FIG. 7, The position sensors 274 and 278 and the actuators 276 and 280 can be connected, via wired or wireless connection, to the computer system 270 to enable detection of the positions of the plug valve 272 and the high pressure bleed valve 264 and to manipulate the positions of the plug valve 272 and the high pressure bleed valve 264. The position sensors 274 and 278 can be implemented in the same or similar way to the position sensor 266 described above. The actuators 276 and 280 can be implemented in the same or similar way to the actuator 268 described above. It will be apparent from the present disclosure that each of the high pressure stations 260 can have multiple connections 258, multiple high pressure bleed valves 264, and multiple plug valves 272 implemented as described above.

The well bore station 262 can also be implemented similarly or the same as described above. For example, in some embodiments, each well bore station 262 can be provided with one or more outlets, which may each include a bleed valve, a high pressure plug valve, and corresponding position sensors and actuators connected to the valves.

FIG. 7 depicts an embodiment of the computer system 270 (also referred to as a control system), which can be connected to the manifold system 226 of FIGS. 2-4. The computer system 270 includes the illustrative sensors 266, 274, 278 and actuators 268, 276, 280 that are depicted in FIGS. 5A and 6. As previously discussed, these sensors and actuators can be coupled with valves of the manifold system 226. As can be appreciated from FIGS. 2-4, in some embodiments, many more sensors and actuators may be used with the computer system 270, as each low pressure station 246 and each high pressure station 260 of the manifold system 226 may have one or more such sensor and actuator. The potential presence of additional sensors and actuators is schematically depicted by the dotted extension at either end of a schematic communication line to which the sensors 266, 274, 278 and the actuators 268, 276, 280 are coupled.

As previously discussed, the computer system 270 can be the computerized control system 125 or can be provided within the computerized control system 125. In various embodiments, the computer system 270 can include a processor 390, a non-transitory computer readable medium 392, and processor executable code 394 stored on the non-transitory computer readable medium 392. The processor 390 can be implemented as a single processor or multiple processors working together or independently to execute the processor executable code 394 described herein. Embodiments of the processor 390 can include a digital signal processor (DSP), a central processing unit (CPU), a microprocessor, a multi-core processor, field programmable gate array (FPGA), and combinations thereof. The processor 390 is coupled to the non-transitory computer readable medium 392. The non-transitory computer readable medium 392 can be implemented in any suitable manner, such as via RAM, ROM, flash memory or the like, and can take any suitable form, such as a magnetic device, optical device or the like. The non-transitory computer readable medium 392 can be a single non-transitory computer readable medium, or multiple non-transitory computer readable mediums functioning logically together or independently.

The processor 390 is coupled to and configured to communicate with the non-transitory computer readable medium 392 via a path 396 which can be implemented as a data bus, for example. The processor 390 can be capable of communicating with an input device 398 and an output device 300 via paths 302 and 304, respectively. Paths 302 and 304 can be implemented similarly to, or differently from path 396. For example, paths 302 and 304 can have a same or different number of wires and can or may not include a multidrop topology, a daisy chain topology, or one or more switched hubs. The paths 396, 302 and 304 can be a serial topology, a parallel topology, a proprietary topology, or combination thereof. The processor 390 is further capable of interfacing and/or communicating with one or more network 306, via a communications device 308 and a communications link 310 such as by exchanging electronic, digital and/or optical signals via the communications device 308 using a network protocol such as TCP/IP. The communications device 308 can be a wireless modem, digital subscriber line modem, cable modem, network bridge, Ethernet switch, direct wired connection or any other suitable communications device capable of communicating between the processor 390 and the network 306.

It is to be understood that in certain embodiments using more than one processor 390, the processors 390 can be located remotely from one another, located in the same location, or comprising a unitary multicore processor (not shown). The processor 390 is capable of reading and/or executing the processor executable code 394 and/or creating, manipulating, altering, and storing computer data structures into the non-transitory computer readable medium 392.

The non-transitory computer readable medium 392 may also be referred to as memory, and can be configured to store processor executable code 394 and can be implemented in any suitable manner, such as via random access memory (RAM), a hard drive, a hard drive array, a solid state drive, a flash drive, a memory card, a CD-ROM, a DVD-ROM, a BLU-RAY, a floppy disk, an optical drive, and combinations thereof. When more than one non-transitory computer readable medium 392 is used, one of the non-transitory computer readable mediums 392 can be located in the same physical location as the processor 390, and another one of the non-transitory computer readable mediums 392 can be located in a location remote from the processor 390, in some instances. The physical location of the non-transitory computer readable mediums 392 can be varied and the non-transitory computer readable medium 392 can be implemented as a "cloud memory," i.e., non-transitory computer readable medium 392 which is partially or completely based on or accessed using the network 306. In one embodiment, the non-transitory computer readable medium 392 stores a database accessible by the computer system 270.

In certain embodiments, the input device 398 transmits data to the processor 390, and can be implemented in any suitable manner and may include, for example, a keyboard, a mouse, a touch-screen, a camera, a cellular phone, a tablet, a smart phone, a PDA, a microphone, a network adapter, a camera, a scanner, and combinations thereof. The input device 398 can be located in the same location as the processor 390, or can be remotely located and/or partially or completely network-based. The input device 398 communicates with the processor 390 via path 302.

In certain embodiments, the output device 300 transmits information from the processor 390 to a user, such that the information can be perceived by the user. For example, the output device 300 can be implemented as a server, a computer monitor, a cell phone, a tablet, a speaker, a website, a PDA, a fax, a printer, a projector, a laptop monitor, and combinations thereof. The output device 300 communicates with the processor 390 via the path 304.

The network 306 can permit bi-directional communication of information and/or data between the processor 390, the network 306, and the manifold system 226. The network 306 can interface with the processor 390 in any suitable manner, for example, by optical and/or electronic interfaces, and can use a plurality of network topographies and protocols, such as Ethernet, TCP/IP, circuit switched paths, file transfer protocol, packet switched wide area networks, and combinations thereof. For example, the one or more network 306 can be implemented as the Internet, a LAN, a wide area network (WAN), a metropolitan network, a wireless network, a cellular network, a GSM-network, a CDMA network, a 3G network, a 4G network, a satellite network, a radio network, an optical network, a cable network, a public switched telephone network, an Ethernet network, and combinations thereof. The network 306 can use a variety of network protocols to permit bi-directional interface and communication of data and/or information between the processor 390, the network 306, and the manifold system 226. The communications between the processor 390 and the manifold system 226, facilitated by the network 306, can be indicative of communications between the processor 390, the position sensors 266, 274, and 278, and the actuator 268, 276, and 280. The communications between the processor 390 and the manifold system 226 can be additionally facilitated by a controller (not shown), which can interface with position sensors 266, 274, and 278 and actuators 268, 276, and 280 as well as the computer system 270. In some embodiments, the controller can be implemented as a controller on the manifold system 226. In another embodiment, the controller can be implemented as a part of the computer system 270 in the computerized control system 125. The controller can be implemented as a programmable logic controller (PLC), a programmable automation controller (PAC), distributed control unit (DCU) and can include input/output (I/O) interfaces such as 4-20 mA signals, voltage signals, frequency signals, and pulse signals which can interface with the position sensors 266, 274, 278 and the actuators 268, 276, and 280.

In some embodiments, the processor 390, the non-transitory computer readable medium 392, the input device 398, the output device 300, and the communications device 308 can be implemented together as a smartphone, a PDA, a tablet device, such as an iPad, a netbook, a laptop computer, a desktop computer, or any other computing device.

The non-transitory computer readable medium 392 can store the processor executable code 394, which can comprise a flow path identification program **394*a*, which may also be referred to as a pairing program 394*a*. The non-transitory computer readable medium 392 can also store other processor executable code 394*b*, such as an operating system and application programs, such as a word processor or spreadsheet program, for example. The processor executable code for the pairing program 394*a* and the other processor executable code 394*b*** can be written in any suitable programming language, such as C++, C #, or Java, for example.

As explained more fully hereafter, the computerized control system 125 and/or the computer system 270 can be configured to identify valves which have hoses or treating iron (e.g., steel piping) connected between the valves and the fracturing pumps 130. In some instances, the identification process occurs during an initial setup or configuration of the system 100, or more particularly, the pumping system 110.

In some instances, a flow path identification process can include the pressurization of a low pressure manifold common to the low pressure valves using the blender 122. In general, the control system 125 can open only those valves that are connected by hoses to the pumps 130, while ignoring or bypassing any valves that do not have hose connections to the pumps. Accordingly, the identification process can include making a determination of which valves have hoses connected to them. This can, in some instances, be accomplished via sensors, as discussed further below. In a specific process, the valves can be opened in a serial fashion, thereby causing one fracturing pump 130 at a time to register a pressure on a suction pressure sensor within that pump 130. The pressurized fracturing pump 130 can then be paired with the valve that was opened to cause the pressurization of the pump, and the pairing can be recorded. The same low pressure valve can be closed leaving the pressure trapped in a line of the fracturing pump 130.

In order to further determine a flow path from the low pressure manifold to the high pressure manifold, certain high pressure valves can be opened to identify which inlet of the high pressure manifold is coupled to the pressurized pump. For example, a subset of high pressure valves that have not previously been assigned to a pump may be opened in a serial fashion. In some instances, the plug valves of the high pressure manifold are maintained in a closed position, and the bleed valves are opened one-by-one to make the identification. In other instances, the bleed valves may be maintained in a closed position, and the high pressure plug valves may be opened one-by-one to make the identification. In either case, if a high pressure valve is opened and pressure is not bled from the pump, no pairing is made between that fracturing pump 130 and the high pressure valve, or a pairing (or potential pairing) of the fracturing pump 130 and the high pressure valve is discarded. However, if the high pressure valve is opened and the fracturing pump 130 loses pressure, a pairing of the fracturing pump 130 and the high pressure valve is recorded. The high pressure valve can then be closed and the process repeated for a subsequent low pressure valve, a subsequent pump, and a subsequent high pressure valve. If one of the fracturing pumps 130 goes offline, the pairings involving that fracturing pump 130 can be discarded. Embodiments of various pairing operations of the computerized control system 125 (which can include the system 270) are explained in further detail below with regards to FIGS. 8-9 and 14-15.

Figure 8:
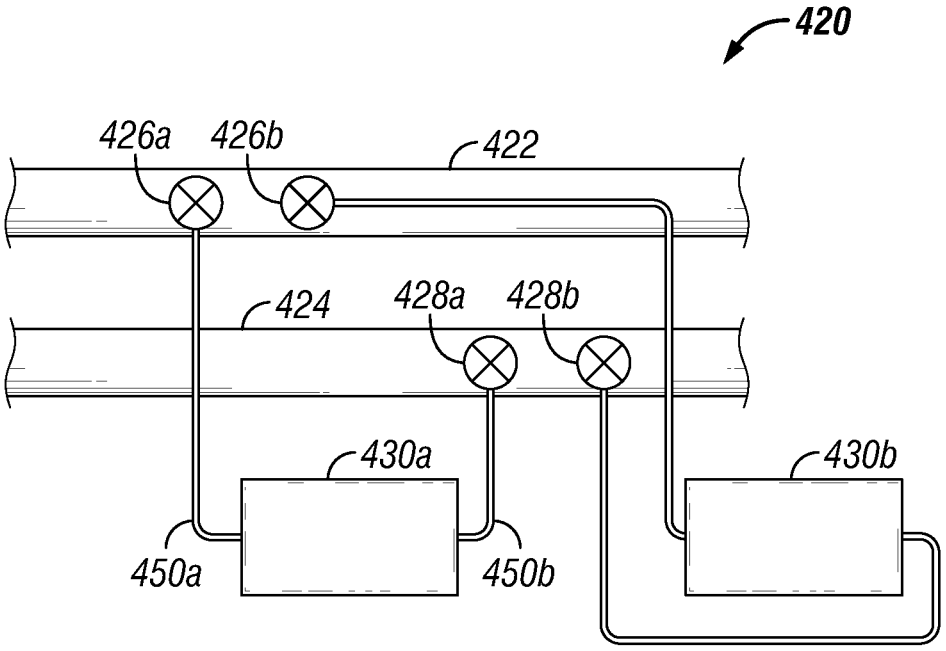
FIG. 8 is a diagrammatic representation of one embodiment of a pump system in accordance with the present disclosure.
Figure 9:
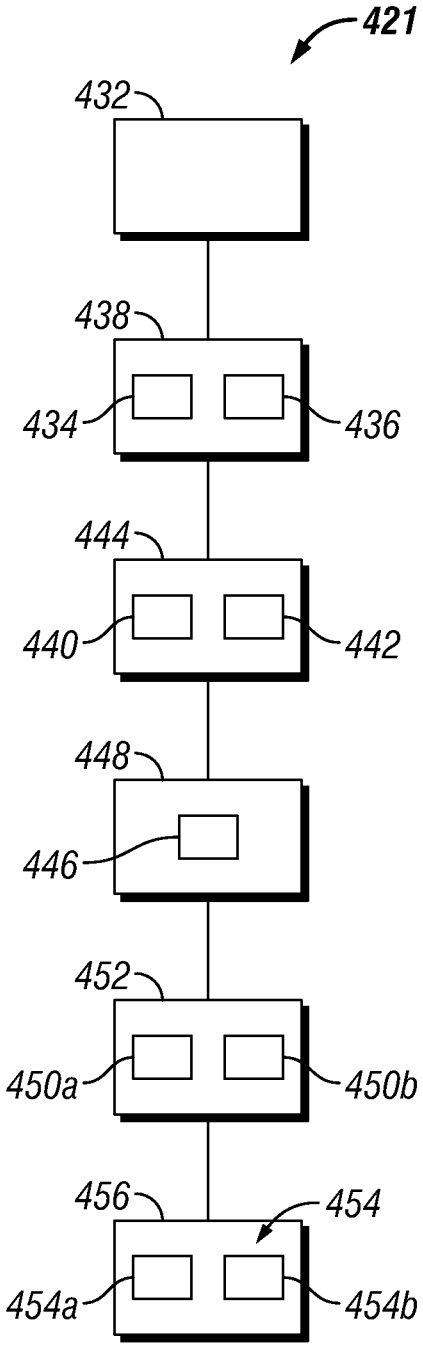
FIG. 9 is a diagrammatic representation of an embodiment of a method of automatically pairing a plurality of pumps and a plurality of valves on the manifold trailer in accordance with the present disclosure.

FIGS. 8 and 9 depict, respectively, an embodiment of a manifold system 420 and a diagrammatic representation of an embodiment of a flow path identification process 421 that can be used with the manifold system 420. The flow path identification process 421 may also be referred to as a pairing process, and the process may be implemented via an embodiment of the flow path identification program 394*a* mentioned above.

With reference to FIG. 8, an embodiment of a manifold system 420 can include a low pressure manifold 422 and a high pressure manifold 424. A first low pressure valve 426*a* and a second low pressure valve 426*b* are connected to the low pressure manifold 422. A first high pressure valve 428*a* and a second high pressure valve 428*b* are connected to the high pressure manifold 424. The high pressure valves 428*a*, 428*b* may each be a plug valve or a bleed valve, such as those described above with respect to the manifold system 226. The first and second low pressure valves 426*a* and 426*b* and the first and second high pressure valves 428*a* and 428*b* can be in fluid communication with a first pump 430*a* and a second pump 430*b*, respectively. The manifold system 420 can be implemented similarly to the manifold system 426 discussed above. The first pump 430*a* and the second pump 430*b* can be implemented the same as or similarly to the fracturing pumps 130 discussed above. Although only the first and second low pressure valves 426*a*, 426*b* and the first and second high pressure valves 428*a*, 428*b* are shown, the manifold trailer 420 can include any suitable number of additional low pressure valves and high pressure valves. Moreover, any suitable number of additional pumps may be coupled with the various additional low and high pressure valves of the manifold 424 in any suitable combination.

With reference to FIG. 9, the flow path identification process 421 can operate on the manifold system 420 of FIG. 8. The flow path identification process 421 can be implemented by an embodiment of the flow path identification program 394*a* (also referred to as a pairing program) mentioned above. At block 432, the processor 230 of the computer system 270 can execute the processor executable code for the pairing program 394*a*.

At block 438, the pairing program 394*a* can cause the processor 390 to create and/or receive identification data 434 indicative of the first low pressure valve 426*a* and to create and/or receive identification data 436 indicative of the second low pressure valve 426*b*, each of which are connected to the low pressure manifold 422 of the manifold system 420. The identification data 434 and 436 can be any suitable information to identify the first low pressure valve 426*a* and second low pressure valve 426*b*. For example, the identification data 434, 436 can include populated matrices or other data or data structures stored within the memory 392 (FIG. 7). In some instances, the identification data 434, 436 is generated by the computer system 270. In other or further instances, the identification data 434, 436 can be read or otherwise sensed from the low pressure valves 426*a*, 426*b* themselves, or from outlets of the low pressure manifold with which the low pressure valves are associated. For example, the identification data 434, 436 can include IP addresses, serial numbers, or any other suitable information. The processor 390 may also store the identification data 434, 436.

At block 444, the pairing program 394*a* can cause the processor 390 to create and/or receive identification data 440 indicative of the first high pressure valve 428*a* and to create and/or receive identification data 440 indicative of the second high pressure valve 428*b*. The identification data 440 and 442 can be any information to identify the first high pressure valve 428*a*, 428*b*. For example, the identification data 440, 442 can include populated matrices or other data or data structures stored within the memory 392. In some instances, the identification data 440, 442 is generated by the computer system 270. In other or further instances, the identification data 440, 442 can be read or otherwise sensed from the high pressure valves 428*a*, 428*b* themselves, or from inlets of the high pressure manifold with which the high pressure valves are associated. For example, the identification data 440, 442 can include IP addresses, serial numbers, or any other suitable information. The processor 390 may also store the identification data 440, 442.

At block 448, the pairing program 394*a* can cause the processor 390 to create and/or receive identification data 446 indicative of the first pump 430*a*. The identification data 446 can be of any suitable variety to identify the pump 430*a*, such as those discussed above with respect to the identification data 434, 436, 440, 442. The processor 390 may also store the identification data 446.

At block 452, after having created, received, and/or stored the identification data 434, 436, 440, 442, and 446, the pairing program 394*a* can cause the processor 390 to determine the presence of a first fluid connection 450*a*, which couples one of the pressure valves 426*a*, 426*b* and one of the pumps 430*a*, 430*b*. In particular, the pairing program 394*a* can determine that the first low pressure valve 426*a* is connected to the pump 430*a* via the first fluid connection 450*a*. The fluid connection 450*a* is depicted in FIG. 8, and can comprise any suitable physical connection, such as the schematically depicted hose. The fluid connection 450*a* can define a portion of a fluid flow path from the low pressure manifold 422 to the high pressure manifold 424. At block 452, the pairing program 394*a* can also cause the processor 390 to determine the presence of a second fluid connection 450*b*, which couples one of the high pressure valves 428*a*, 428*b* with one of the pumps 430*a*, 430*b*. In particular, the pairing program 394*a* can determine that the high pressure valve 428*a* is connected to the pump 430*a* via the second fluid connection 450*b*. The fluid connection 450*b* is depicted in FIG. 8, and can comprise any suitable physical connection, such as the schematically depicted treating iron. Accordingly, the pairing program 430*a* can determine the presence of a flow path that extends from the low pressure manifold 422 to the high pressure manifold 424.

As shown at block 456, in some instances, after determining the presence or existence the first fluid connection 450*a* and the second fluid connection 450*b*, the pairing program 394*a* can cause the processor 390 to populate the non-transitory computer readable medium 392 with a first association 454*a* indicative of the first fluid connection 450*a*, and a second association 454*b* indicative of the second fluid connection 450*b*. Although depicted in FIG. 9 as separate first and second associations 454*a*, 454*b*, in other instances, the processor 390 can populate the non-transitory computer readable medium 392 with a single association 454 that is indicative of the first fluid connection 450*a* and the second fluid connection 450*b*. Stated otherwise, the processor 390 may create and store a flow path definition, or association 454, that is indicative one or more physical flow paths from the low pressure manifold to the high pressure manifold. In some instances, blocks 452 and 456 may be performed simultaneously.

Creating the associations 454*a*, 454*b* depicted at block 456 of the process 421 can be achieved in a number of ways, as discussed immediately hereafter. For example, a variety of systems and processes are available for identifying the physical presence of the first and second fluid connections 450*a*, 450*b* (as depicted at block 452 of the flow path identification process 421). One or more flow path definitions, or associations, can be created from these identifications, as depicted by items 454, 454*a*, and 454*b* in FIG. 9. The flow path definitions can be stored in the computer readable medium 392. The discussion regarding FIGS. 10-13 that follows is directed to systems and methods that can be used both for the identification of the physical connections (block 452 in FIG. 9) and for the creation of computer-readable representations thereof, e.g., "associations" or "flow path definitions" (block 456 in FIG. 9).

Figure 10:
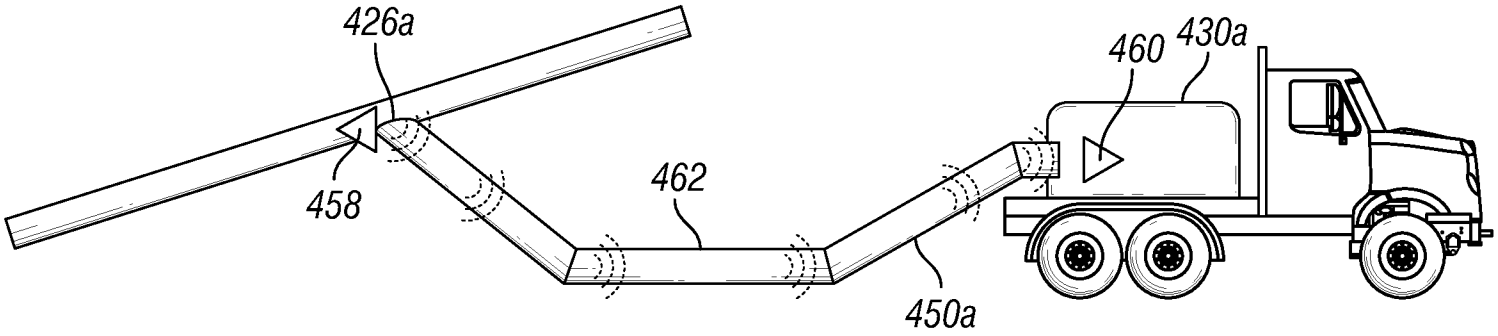
FIG. 10 is a diagrammatic representation of one embodiment of a method of determining a fluid connection for the method of automatically pairing the plurality of pumps and the plurality of valves on the manifold trailer of FIG. 9.

As shown in FIG. 10, in one embodiment, the associations 454, such as the first association 454*a*, can be determined by passing signals, via the first fluid connection 450*a*, between a first transceiver 458 located at the first low pressure valve 426*a* and a second transceiver 460 located at the first pump 430*a*. The first fluid connection 450*a*, for example, can be formed using a hose 462. The signals used to form the first association 454*a*, for example, can be passed through a fracturing fluid within the hose 462, the hose 462 itself, and/or a wired connection extending along, on, or through the hose 462. In the same manner (although not shown in FIG. 10), the second fluid connection 450*b* between the pump 430*a* and the high pressure valve 428*a*, for example, can be formed by passing signals along or through piping, also commonly referred to as treating iron.

The pairing program 394*a* can cause the processor 390 to detect the presence of the first fluid connection 450*a*, and further, to create the first association 454*a* as a representation of that physical connection, by enabling the first and second transceivers 458 and 460 to swap or otherwise communicate identification data 434 and 446 from one transceiver to the other. This can be accomplished, for example, by transmitting a pulse or identification data 434 of the first low pressure valve 426A from the first transceiver 458 to the second transceiver 460. The identification data 434 can be stored in a memory or other suitable device within or accessible by the first transceiver 458. The identification data 446 can be stored in a memory or other suitable device within or accessible by the second transceiver 460.

The first and second transceivers 458 and 460 are configured to communicate via any suitable medium, such as electrical signals, optical signals, pressure signals, or acoustic signals. In certain embodiments, once the association is formed, either the first transceiver 458 or the second transceiver 460 passes a signal to the processor 390, which can store the association in the non-transitory computer readable medium. Moreover, in other embodiments, a transmitter/receiver pair, or any suitable arrangement of transmitters and receivers, may be used in place of a set of transceivers. The transceivers 458, 460 or, in the case of a transmitter/receiver pair, the receiver, may also be referred to as sensors. The computer system 270 may include or otherwise be configured to communicate with the transceivers 458, 460 (or other communication devices). Additional associations can be formed in manners such as just described. Such associations can be between the first pump 430*a* and a high pressure valve of the high pressure manifold, as well as for additional hoses coupled between additional low pressure valves and additional pumps and for additional treating iron coupled between the pumps and additional high pressure valves.

Figure 11:
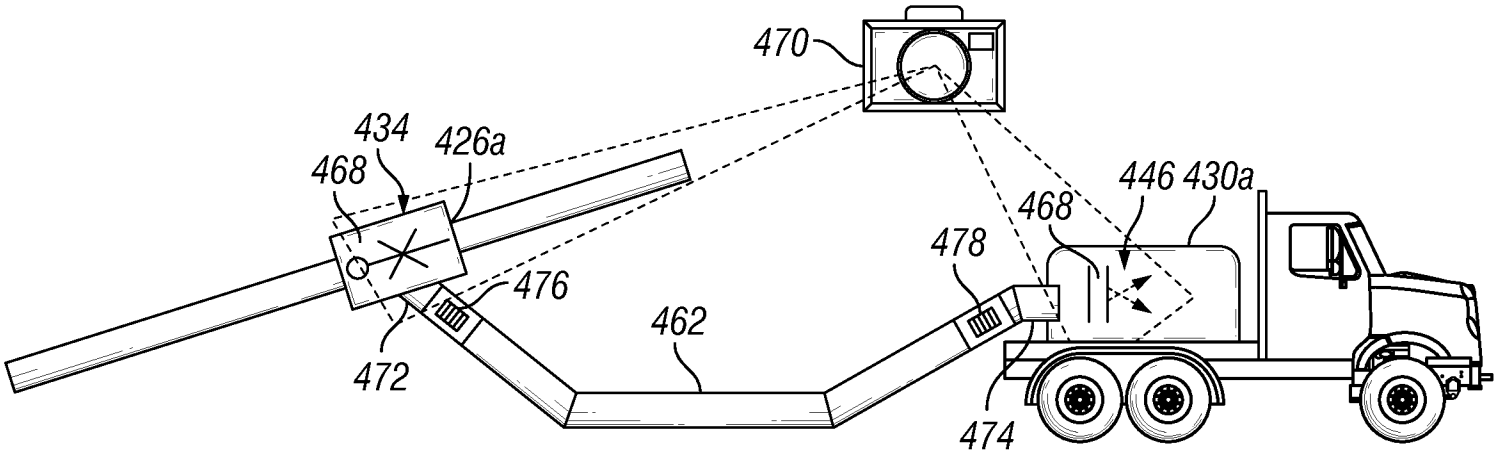
FIG. 11 is a diagrammatic representation of another embodiment of a method of determining a fluid connection for the method of automatically pairing the plurality of pumps and the plurality of valves on the manifold trailer of FIG. 9.

As shown in FIG. 11, in other or further embodiments, the pump system 110 includes one or more readers 470, which are used in forming the first association 454*a* and the second association 454*b*. In this example, the identification data 434 of the first low pressure valve 426*a* and the identification data 446 of the first pump 430*a* can be represented by unique symbols 468, such as bar codes or other graphical symbols that are visible to and/or readable by the readers 470. The hose 462 has a first end 472 and a second end 474. A first identification data 476 is applied to the hose 462 adjacent to the first end 472, and a second identification data 478 is applied to the hose 162 adjacent to the second end 474, in the illustrated embodiment. The reader 470, which can be a camera, a bar code scanner, RFID scanner, or optical character recognition scanner, for example, can have a computer program prompting a user to capture image data, radio frequency data, or other suitable data, or the reader 470 may be configured to capture the image or otherwise sense the data automatically. The reader 470 can capture the identification data 434 of the first low pressure valve 426*a* and the first identification data 476 of the hose 462 to form an association of the first low pressure valve 426*a* with the first end 472 of the hose 462. Similarly, the reader 470 can capture the identification data 446 of the first pump 430*a* and the second identification data 478 at the second end of the hose to form an association of the first pump 430*a* with the second end 474 of the hose 462. The reader 470 or any other suitable portion of the control system 125 or computer system 270 can utilize this information to form the first association 454*a*. The computer system 270 may include the reader 470, or may otherwise be configured to communicate with the reader 470. The reader 470 may also be referred to as a sensor. Additional associations can be formed in like manner, such as between the first pump 430*a* and a high pressure valve of the high pressure manifold, as well as for additional hoses coupled between additional low pressure valves and additional pumps and for additional treating iron coupled between the pumps and additional high pressure valves.

Figure 12:
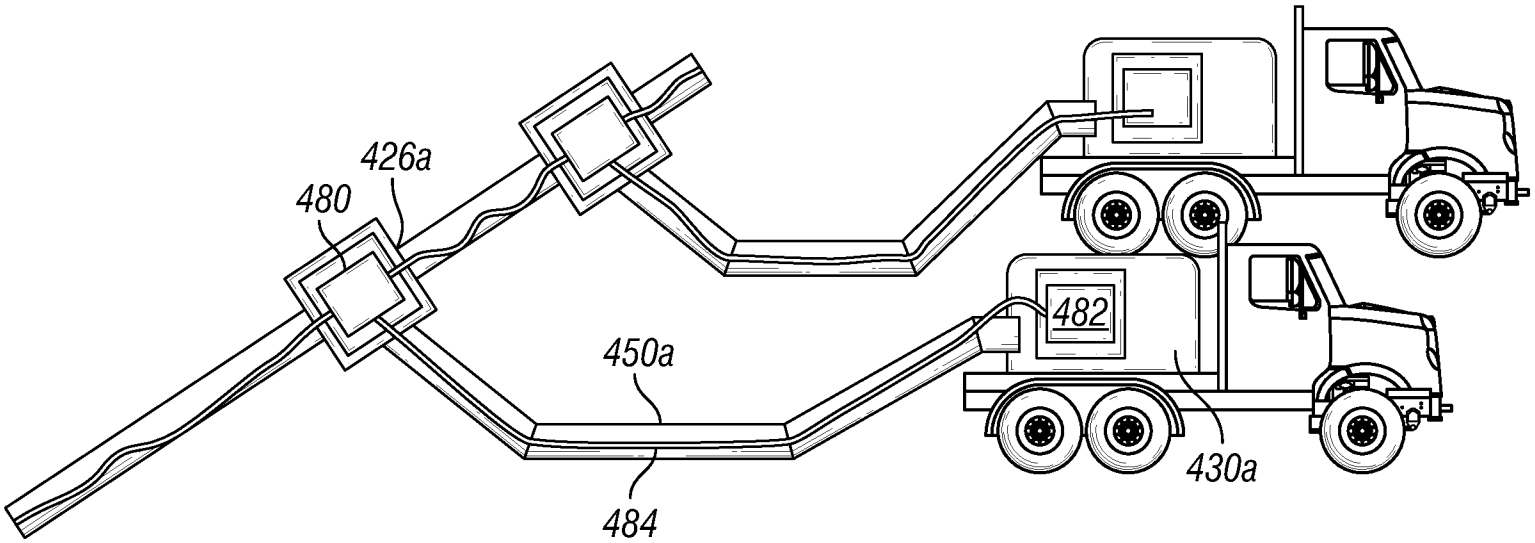
FIG. 12 is a diagrammatic representation of an embodiment of a method of determining a fluid connection for the method of automatically pairing the plurality of pumps and the plurality of valves on the manifold trailer of FIG. 9.

Referring now to FIG. 12, in other or further embodiments, the first fluid connection 450*a* can be determined by inductive coupling, such as between a wire and a sensor. In the illustrated embodiment, the pump system 110 can include a controller 480 connected to or near the first low pressure valve 426*a* and circuitry 482 can be connected to the first pump 430*a*. Upon establishing the first fluid connection 450*a* the controller 480 and the circuitry 482 can be coupled via a wired connection 484, such that the wired connection 484 inductively couples the controller 480 and the circuitry 482 such that a change in the current flow through the wired connection 484 can cause the controller 480 to receive a voltage. The controller 480 can transmit the identification data 434 for the first low pressure valve 426*a* and the identification data 446 for the first pump 430*a* to the processor 390, thereby enabling the processor 390 to determine the first fluid connection 450*a* and the first association 454*a*.

Figure 13:
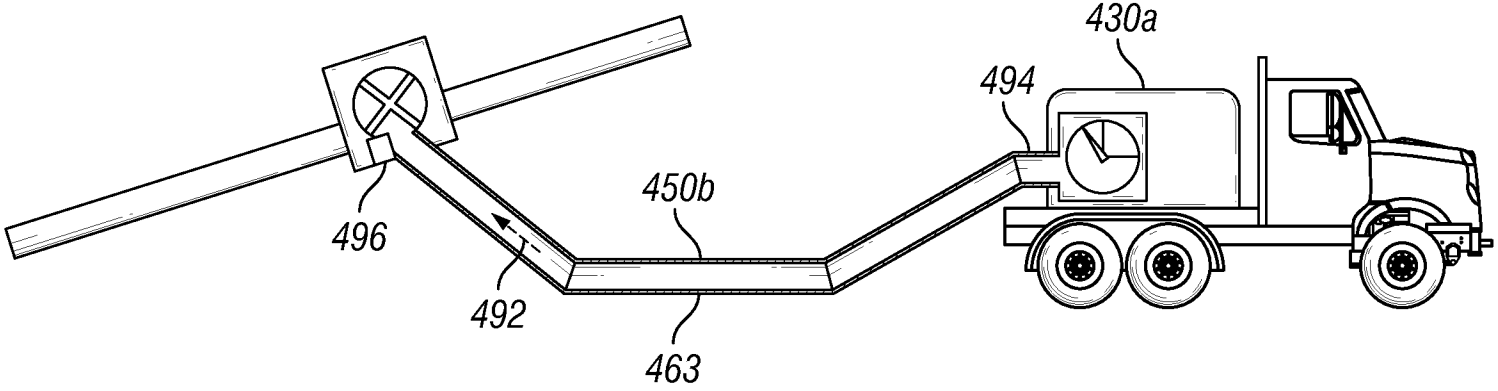
FIG. 13 is a diagrammatic representation of another embodiment of a method of determining a fluid connection for the method of automatically pairing the plurality of pumps and the plurality of valves on the manifold trailer of FIG. 9.

Referring now to FIG. 13, in some embodiments, the second fluid connection 450*b* can be determined by passing pressure pulses through the treating iron 463. In this embodiment, the processor 390 can receive the identification data 446 of the first pump 430*a* and cause the first pump 430*a* to generate a pressure pulse 492 in a pump output 494 connected to the treating iron 463. The pressure pulse 492 can be generated by initiating the first pump 430*a* for a predetermined number of revolutions. The first pump 430*a* generating the pressure pulse 492, can cause the pressure pulse 492 to be within a safety threshold of the first high pressure valve 428*a* and allow a transmission of the first pump 430*a* to stall before the pressure at the pump output 494 exceeds the safety threshold of the first high pressure valve 428*a*. The pressure pulse 492 can be detected by a sensor 496 mounted on the first high pressure valve 428*a*, causing the sensor to transmit the identification data 440 of the first high pressure valve 428*a* to the processor 390, thereby enabling the processor 390 to determine the second fluid connection 450*b* and the second association 454*b*.

Figure 14:
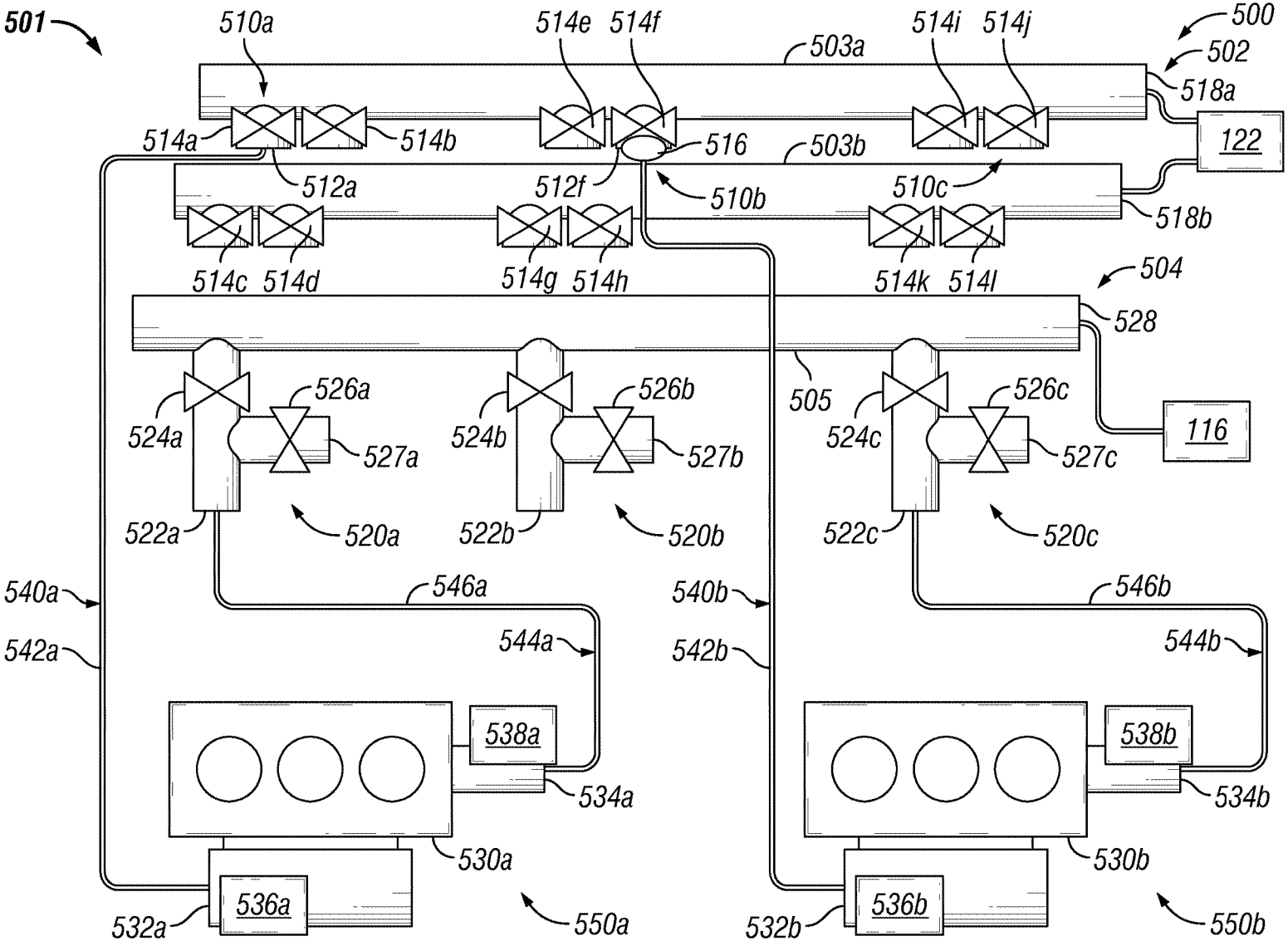
FIG. 14 is a diagrammatic representation of one embodiment of a pump system in accordance with the present disclosure.

FIG. 14 is a schematic representation of another embodiment of a manifold system 500, which can resemble the manifold systems 226, 420 in many respects. The manifold system 500 includes a low pressure manifold 502 and a high pressure manifold 504. The low pressure manifold 502 can include one or more conduits 503*a*, 503*b*. The high pressure manifold 504 likewise can include one or more conduits 505. In the illustrated embodiment, the low pressure manifold 504 includes two separate conduits 503*a*, 503*b* and the high pressure manifold includes a single conduit 505.

The low pressure manifold 502 can include a plurality of low pressure stations 510*a*, 510*b*, 510*c*. In the illustrated embodiment, the low pressure manifold 502 includes three low pressure stations, and each low pressure station includes four outlets 512. For example, the low pressure station 510*a* includes an outlet 512*a*, which is coupled with a conduit for delivering a fluid to a pump, as discussed further below, and further includes three additional outlets that are not coupled with conduits. Similarly, the low pressure station 510*b* includes an outlet 512*f* that is coupled with a conduit for delivering a fluid to a pump, as discussed further below, and further includes three additional outlets that are not coupled with conduits. None of the four outlets at the low pressure station 510*c* is coupled with a conduit for delivering fluid to a pump.

Each of the outlets 512 of the low pressure manifold 502 can be coupled with a valve 514. In particular, the low pressure station 510*a* includes four outlets coupled with the valves 514*a*, 514*b*, 514*c*, and 514*d*, respectively; the low pressure station 510*b* includes four outlets coupled with the valves 514*e*, 514*f*, 514*g*, and 514*h*, respectively; and the low pressure station 510*c* includes four outlets coupled with the valves 514*i*, 514*j*, 514*k*, and 514*l*, respectively. The valves 514 may be of any suitable variety, and can be configured to selectively permit, prevent, and/or otherwise control fluid flow through the outlets 512.

The low pressure manifold 502 can include any suitable number of inlets 518*a*, 518*b* by which the conduits 503*a*, 503*b* can be coupled with a blender 122. As previously discussed with respect to other embodiments, one or more so-called blender stations may include the inlets 518*a*, 518*b*, and the inlets can be equipped with valves to selectively permit, prevent, and/or otherwise control fluid flow through the inlets.

The high pressure manifold 504 can include a plurality of high pressure stations 520*a*, 520*b*, 520*c*. In the illustrated embodiment, the high pressure manifold 504 includes three high pressure stations, and each high pressure station includes a single inlet 522. For example, the high pressure station 520*a* includes an inlet 522*a*, which is coupled with a conduit for receiving a fluid from a pump and delivering the fluid to the high pressure manifold, as discussed further below. Similarly, the high pressure station 520*c* includes an inlet 522*c* that is coupled with a conduit for delivering fluid from a pump. However, an inlet 522*b* of the high pressure station 520*b* is not coupled with any conduits for delivering fluid from a pump.

Each of the inlets 522 of the high pressure manifold 504 can be coupled with a plurality of high pressure valves. In the illustrated embodiment, each inlet 522 is coupled with a plug valve 524 and a bleed valve 526. The plug valves 524*a*, 524*b*, 524*c* can be of any suitable variety and can be configured to selectively permit, prevent, and/or otherwise control fluid flow from the inlets 522*a*, 522*b*, 522*c* into the high pressure conduit 505. The bleed valves 526*a*, 526*b*, 526*c* can be of any suitable variety and may each be coupled with a separate bleed port 527*a*, 527*b*, 527*c*. The bleed valves 526*a*, 526*b*, 526*c* can be configured to selectively permit, prevent, and/or otherwise control fluid flow from the inlets 522*a*, 522*b*, 522*c* through the bleed ports 527*a*, 527*b*, 527*c*. As can be appreciated, each bleed port 527*a*, 527*b*, 527*c* can be coupled with one or more bleed lines into which fluid can be delivered to relieve pressure from the high pressure inlets.

The high pressure manifold 504 can include any suitable number of outlets 528 by which the high pressure conduit 505 can be coupled with a well bore 116. As previously discussed with respect to other embodiments, one or more so-called well bore stations may include the one or more outlets 528, and the outlets can be equipped with valves to selectively permit, prevent, and/or otherwise control fluid flow through the outlets.

As just discussed, in the illustrated embodiment, the manifold system 500 includes three low pressure stations and three high pressure stations. Any other suitable number and configurations of the low and high pressure stations is contemplated. In many instances, the manifold system 500 (which may also be referred to as a missile, as previously discussed) may include more than three low and high pressure stations.

In the illustrated embodiment, the manifold system 500 has been coupled with two pumps 530*a*, 530*b*. The pumps can be of any suitable variety, such as those discussed above, and can be configured to pressurize fluid received from the low pressure manifold 502 for subsequent delivery to the high pressure manifold 504. Each pump 530*a*, 530*b* can include a low pressure inlet 532*a*, 532*b* for coupling with the low pressure manifold 502 and can include a high pressure outlet 534*a*, 534*b* for coupling with the high pressure manifold 504, respectively. In the illustrated embodiment, each low pressure inlet 532*a*, 532*b* is coupled with a pressure sensor 536*a*, 536*b*, respectively. The pressure sensors 536*a*, 536*b* may also be referred to as suction pressure sensors and can be configured to detect or determine a pressure and/or a change in pressure at or near the inlets 532*a*, 532*b*. In the illustrated embodiment, each high pressure outlet 534*a*, 534*b* is coupled with a pressure sensor 538*a*, 538*b*, respectively. The pressure sensors 538*a*, 538*b* can be configured to detect or determine a pressure and/or a change in pressure at or near the outlets 536*a*, 536*b*

The pressure sensors 536*a*, 536*b*, 538*a*, 538*b* are schematically depicted as boxes. The sensors may be configured and positioned in any suitable manner. The pressure sensors may be coupled with the control systems 125, 270 discussed above. In some embodiments, the pressure sensors 536*a*, 536*b* can be low pressure sensors configured to sense in a range of from about 0 to about 150 psi, and the pressure sensors 538*a*, 538*b* can be high pressure sensors configured to sense in a range of from about 0 to about 50,000 psi. In certain of such embodiments, the low pressure sensors can be used when pairing the high pressure bleed valves 526*a*, 526*b*, 526*c* with fracturing pumps and outlets of the low pressure valves 514 of the low pressure manifold 502 to utilize a relatively higher resolution provided by the low pressure sensors (as compared to the high pressure sensors). In certain embodiments, a single pressure sensor may comprise the pressure sensors 536*a*, 538*a* of the pump 530*a* and a single pressure sensor may comprise the pressure sensors 536*b*, 538*b* of the pump 530*b*.

With continued reference to FIG. 14, any suitable conduits 540*a*, 540*b* can be used to couple the outlets of the low pressure manifold 502 (e.g., the outlets 512*a*, 5120 with the inlets (e.g., the inlets 532*a*, 532*b*) of fracturing pumps (e.g., the pumps 530*a*, 530*b*). For example, the conduits 540*a*, 540*b* can comprise hoses 542*a*, 542*b*. Similarly, any suitable conduits 544*a*, 544*b* can be used to couple the outlets of the fracturing pumps (e.g., the pumps 530*a*, 530*b*) with the inlets of the high pressure manifold 504 (e.g., the inlets 522*a*, 522*c*). For example, the conduits 544*a*, 544*b* can comprise treating iron 546*a*, 546*b*.

In some embodiments, the outlets 512 of the low pressure manifold 502 and the inlets 522 of the high pressure manifold 504 can be coupled with sensors or other identification systems to aid in determining whether a conduit has been coupled therewith. For example, any suitable identification systems and methods discussed above with respect to FIGS. 10-13 may be employed with the outlets 512 and/or the inlets 522. In the illustrated embodiment, a sensor 516 is coupled with the outlet 512*f*. Although the sensor 516 is the only sensor 516 shown in FIG. 14, each low pressure outlet and each high pressure inlet may similarly include a sensor for detecting whether a connection is presence at a given outlet or inlet.

In some embodiments, the sensor 516 can be configured to prevent a conduit 540*a*, 540*b*, 544*a*, 540*b* from being connected to a low pressure outlet or a high pressure inlet when the sensor 516 is in one orientation and can be configured to permit a connection to occur when the sensor is in another orientation. For example, the sensor 516 may be configured to be maintained in a default position when no conduit is connected to the outlet or inlet with which the sensor 516 is associated. The sensor 516 may be moved from the default position to a displaced position to permit a connection to be made with the associated outlet or inlet. In some embodiments, the presence of the conduit can cause the sensor 516 to remain in the displaced position. Displacement of the sensor 516 thus can indicate that a conduit has been coupled to the outlet or inlet. The sensor 516 may be maintained in the default position in any suitable manner, such as via gravity, spring action, or any other suitable mechanism.

Movement of the sensor 516 from the default position may generate a signal that can be delivered to the computer system 270 indicative of a conduit having been coupled to an outlet or an inlet, and thus the computer system 270 can determine that one or more valves that are associated with the outlet or inlet are likewise coupled to a conduit. When the conduit is removed, the sensor 516 can return to its natural position and discontinue the signal, indicating no conduit is coupled to the outlet or inlet. The sensor 516 and signal generated thereby can be a failsafe such that if the sensor 516 fails, a particular valve is indicated to the computer system 270 as having no conduit connection.

Other configurations of the sensor 516 are contemplated. For example, in various embodiments, the sensor 516 can comprise one or more of a contact sensor and an inductive sensor. Any other suitable system or method for sensing connection of the conduit to the low pressure outlet or high pressure inlet is contemplated. The sensor 516 generally can be configured to provide a first signal or indication when a valve is in a coupled arrangement with a conduit and can be configured to provide a second signal or indication when the valve is not in a coupled arrangement with a conduit.

A flow path 550 from the low pressure manifold 502 to the high pressure manifold 504 can be defined when a conduit 540 joins one of the low pressure outlets 512 with an inlet 532 of a pump 530 and when another conduit 544 joins an outlet 534 of the pump with an inlet 522 of the high pressure manifold 504. The flow path 550 is a passageway along which a fluid can be delivered from the low pressure manifold 502 to the high pressure manifold 504. For example, with continued reference to FIG. 14, a flow path 550*a* can extend through the outlet 512*a*, the conduit 540*a*, the pump 530*a*, the conduit 544*a*, and through the inlet 522*a*. Accordingly, the low pressure valve 514*a*, the high pressure plug valve 524*a*, and the bleed valve 526*a* are all in fluid communication with the flow path 550*a*. More particularly, the low pressure valve 514*a* is in fluid communication with a first end of the fluid path 550*a* that extends through the outlet 512*a* and each of the plug valve 524*a* and the bleed valve 526*a* are in fluid communication with another end of the fluid path 550*a* that extends through the inlet 522*a*. In contrast, the remaining valves are not in fluid communication with the flow path 550*a*, or stated otherwise, are not in continuous fluid communication with the flow path 550*a*, given that when the valve 514*a* is closed, none of the valves 514*b*-514*l* are in fluid communication with the flow path 550*a* and similarly, when the plug valve 524*a* is closed, none of the plug valves 524*b*, 524*c* or bleed valves 526*b*, 526*c* are in fluid communication with the flow path 550*a*. It can be said that the pump 530*a* defines a portion of the flow path 550*a*, given that the flow path 550*a* extends through the pump 530*a*.

In the illustrated configuration, another flow path 550*b* extends through the outlet 512*f*, the conduit 540*b*, the pump 530*b*, the conduit 544*b*, and the inlet 522*c*. Moreover, none of the remaining valves or the remaining pump are in fluid communication (e.g., constant or continuous fluid communication) with the flow path 550*b* due to the ability of the valve 514*f* to selectively isolate the flow path 550*b* from the low pressure manifold 502 and due to the ability of the valve 524*c* to selectively isolate the flow path 550*b* from the high pressure manifold 504.

Figure 15:
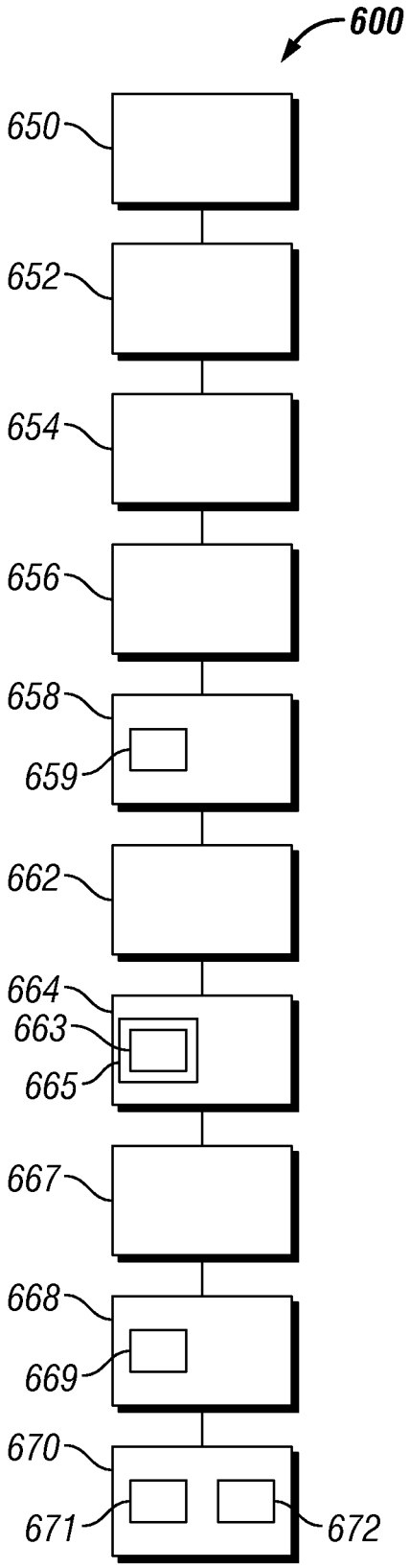
FIG. 15 is a diagrammatic representation of a method of automatically pairing a plurality of pumps and a plurality of valves on the manifold trailer in accordance with the present disclosure.

FIG. 15 is a diagrammatic representation of another embodiment 600 of a pairing program 394*a* (see FIG. 7). The pairing program 600 can comprise an automated process for determining fluid connections between any of the plurality of low pressure valves 514*a*-514*l* with any of the plurality of fracturing pumps 530*a*, 530*b* and any of the plurality of high pressure valves pairs 524*a*/526*a*, 524*b*/526*b*, 524*c*/526*c*. Stated otherwise, the pairing program 600 can be configured to determine or identify the flow paths from the low pressure manifold 502 to the high pressure manifold 504, such as the flow paths 550*a*, 550*b* and to identify the valves associated with each flow path. This may also be referred to as mapping the pumps 530*a*, 530*b* to the valves of the manifold assembly 500. It may also be referred to as creating a flow path definition of the manifold assembly 500 and the pumps 530*a*, 530*b*. The flow path definition can include an identification of each set of low pressure valve, pump, and high pressure valves.

In the pairing program 600, at block 650, the processor 390 of the computer system 270 can execute the processor executable code for the pairing program 394*a*. At block 652, the processor 390 can determine whether each of the low pressure valves 514*a*-514*l* and each of the high pressure valves 524*a*-524*c*, 526*a*-526*c* are in fluid communication with any fluid conduits (e.g., the fluid conduits 540*a*, 540*b*, 544*a*, 544*b*) and thus, inferentially, are in fluid communication with any fracturing pumps. In the illustrated embodiment, at block 652, it is not determined which pumps each valve may be in fluid communication with. Rather, it is merely determined whether each valve is in fluid communication with any pump, as inferred from the presence of a connection between a conduit and an outlet 512 or inlet 522 with which a given valve is associated.

In certain embodiments, the processor 390 can evaluate information received from the sensors 516 (see FIG. 14) that are coupled with each of the low pressure outlets and high pressure inlets to determine whether each valve is coupled with a pump.

In other embodiments, block 652 may be combined with those at block 658 (which are discussed further below). For example, rather than using sensors 516 that provide signals indicative of a connection to a conduit, caps (not shown) may be installed on unused outlets and inlets. The caps can prevent unintentional fluid discharge from either the low pressure manifold 502 or the high pressure manifold 504. The caps thus can be used to permit valves that are not coupled to conduits or pumps to be opened without resulting in fluid discharge from the manifolds 502, 504. By way of example, the low pressure valves can be opened one at a time to determine whether pressure increases at one of the pumps (as discussed further below at block 658). If pressure does increase, it can be determined that the valve is coupled not only with any of the pumps, but with the specific pump at which the pressure increase occurs. On the other hand, if a low pressure valve is opened and no pressure increase can be detected at any of the fracturing pumps, it can be determined that the low pressure valve is not connected to a conduit or fracturing pump.

In certain embodiments, if it is determined that certain of the low pressure valves and high pressure valves are not coupled to any of the plurality of fracturing pumps, those valves may be closed and may no longer be addressed or otherwise utilized by the processor 390 during further stages of the pairing program 600.

At block 654, the processor 390 can determine a status of each of the low pressure valves and the high pressure bleed valves. In some embodiments, the processor 390 also determines the status of the plurality of high pressure plug valves. The status can indicate whether the low pressure valves and the high pressure valves are open, closed, or in an intermediate state between open and closed. The processor 390 can determine the status of the valves using position sensors (such as the position sensors 266, 274, 278 discussed above). If the processor 390 determines that any of the valves are open or in the intermediate status, the processor 390 can cause actuators (such as the actuators 268, 276, 280 discussed above) to close the respective valves to which they are coupled.

At block 656, after determining the status of the valves and after having closed the valves, the processor 390 can pressurize the low pressure manifold 502, such as by opening one or more valves of the low pressure manifold inlets 518*a*, 518*b*, which are coupled with the blender 122. Opening one or more connections between the blender 122 and the low pressure manifold 502 can allow pressure from the blender 122 to pressurize pipes 503*a*, 503*b*, as shown in FIG. 15. This stage can be performed without initiation of any of the pumps 530*a*, 530*b*. In some embodiments, the one or more inlets 518*a*, 518*b* can be closed after the low pressure manifold 602 has been pressurized.

At block 658, the processor 390 can initiate or activate an actuator (such as the actuator 268 discussed above) connected to the low pressure valve 514*a* to open the low pressure valve 514*a*, which can cause the conduit 540*a* to be pressurized. The processor 390 can receive a signal 659 from the pressure sensor 536*a* of the pump 530*a* indicative of a pressure increase on the first pump 530*a*.

At block 662, the processor 390 can then close the first low pressure valve 514*a*, thereby retaining pressure between the low pressure valve 514*a* and the first pump 530*a* via the conduit 540*a*.

At block 664, the processor 390 can form and store information indicative of an association 663 between the first low pressure valve 514*a* and the first pump 530*a* within the one or more non-transitory computer readable medium 392. For example, the processor 390 can store the association 663 of the first low pressure valve 514*a* and the first pump 530*a* in a data structure 665, such as a database of associations, a spread sheet, or any other suitable data storage device or devices. In some embodiments, the association can be viewed, edited, modified, or recalled, such as by an operator. The operator may, for example, be able to visually identify the association of the first low pressure valve 514*a* and the first pump 630*a* via a display or other interface. This order of these activities is illustrative only. Some embodiments may vary process steps, information storage, and how control is administered.

At block 667, the processor 390 can selectively open and close, individually (serially), the plurality of high pressure bleed valves 526*a*, 526*b*, 526*c*. At block 668, the processor 390 can detect whether or not pressure at the first pump 530*a* decreases. The pressure reading can be delivered as a signal 669 from the second pressure sensor 538*a* of the first pump 530*a*, in some instances. If the pressure does not decrease, then it can be determined that that first pump 530*a* is not in fluid communication with the particular bleed valve 526 that had been opened. Likewise, it can be determined that the first pump 530*a* is not coupled with either the high pressure inlet 522 or the high pressure plug valve with which that bleed valve 526 is associated. However, if the pressure does decrease when a particular bleed valve 526 is opened, then the program or process can proceed to block 670.

The process at block 667 can be repeated serially, opening and then closing one bleed valve and then moving to the next, until a pressure decrease is detected. For example, with reference to FIG. 14, in one instance, block 667 may commence with the opening and closing of the high pressure bleed valve 526*c*, which would not result in a decrease in pressure at the first pump 530*a*. In some instances, the high pressure bleed valve 526*b* might then be opened, which also would not result in a decrease in pressure at the first pump 530*a*. However, in other processes, no attempt would be made to open the bleed valve 526*b* if it had already been determined that no conduit was connected to the inlet 522*b*. In either case, the process would eventually come to bleed valve 526*a*. Opening of this valve would result in a pressure drop, and thus the process would move to block 670.

At block 670, once the processor 390 has detected the decrease in pressure, the processor 390 can form an association 671 between the selected high pressure valve 526*a* and the first pump 530*a*. In one embodiment, the processor 390 can do this by storing the association 671 within the one or more non-transitory computer readable medium 392. For example, the processor 390 can store the association of the first high pressure valve 526*a* and the first pump 630*a* in the data structure 665. In some instances, a user or operator can visually identify the association 671 in the same data structure 665 as the association 663 of the first low pressure valve 514*a* and the first pump 530*a*.

In some embodiments, based on the information that resulted in the formation of the associations 663, 671, the processor 390 can additionally form a further association 672 representing the coupling of the first low pressure valve 514*a*, the first pump 530*a*, and the first high pressure bleed valve 526*a*. In further instances, the association 672 can further indicate that the high pressure plug valve 524*a* is also coupled with the first pump 530*a*. The association 672 can generally be a representation of the flow path 550*a*, including the pump and the valves associated therewith. Accordingly, the association 672 may also be referred to as a flow path definition.

At the completion of block 670, the process 600 may cycle back through and repeat blocks 656 through 670 until a flow path definition for each flow path has been created. After valves have been assigned to a flow path definition, the process can skip over those valves in subsequent pairing iterations. Similarly, any valve that has previously been identified as not being connected to a fluid conduit or pump can likewise be skipped over during pairing iterations. The repetition of blocks 656 through 670 can proceed for each unassigned, pump-coupled valve in any suitable predetermined or random pattern.

In some instances, if one of the plurality of fracturing pumps 530 that is known to be connected to the manifold 500 is not automatically paired successfully, an operator can have the ability to manually pair the fracturing pump 530 using a suitable user interface with the computer system 370. The operator may be able to revise or otherwise manipulate a flow path definition of the entire system. Moreover, in some embodiments, one or more of the foregoing steps can be initiated and/or carried out by an operator, rather than fully automatically by the processor.

In some embodiments, once all of the flow path definitions have been created, a master or overall flow path definition may be created or stored. The master flow path definition may merely be the amalgam of all of the individual flow path definitions that have been created with respect to each individual pump. The master flow path definition may represent all of the pumps 530 and all of the low pressure outlets, high pressure inlets, and associated valves of a manifold system 500 and blender 122. The flow path definitions and master flow path definitions can be used to control operation of the manifold valves and the pumps, as discussed further below.

Figure 16:
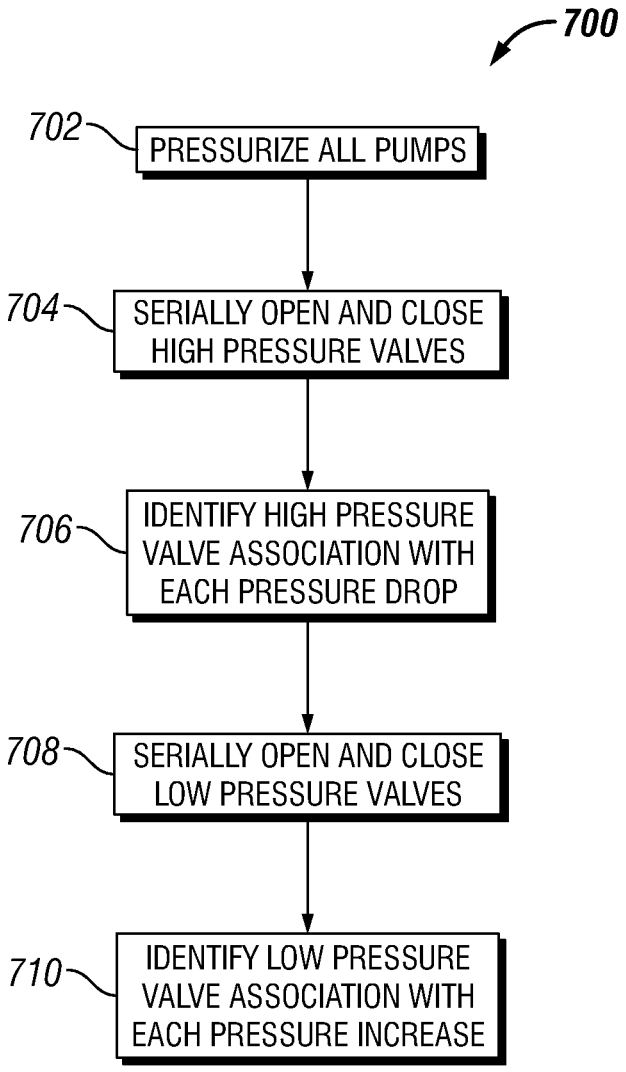
FIG. 16 is a flow chart depicting an example of a method for determining a flow path definition of a pumping system.

FIG. 16 depicts another method 700 for creating a flow path definition of a system that includes a manifold system coupled with a plurality of pumps, for example, the system 501 of FIG. 14 that includes a manifold system 500 and the pumps 530*a*, 530*b*. The method 700 may utilize any suitable control system, such as the control systems discussed above. For example, much or all of the method 700 may be automated and may be executed by a processor or the like. For the purposes of the present discussion, specific mention will be made to the system 500 in FIG. 14. These references are merely by way of illustration. It is to be understood that the methods and processes disclosed can be suitably used with a variety of manifold systems and pumps. Moreover, the method may be used with the same manifold and the same or a different set of pumps that are connected in a variety of different configurations.

At block 702, all of the pumps that are connected to a manifold system are pressurized. For example, with reference to FIG. 14, the blender 122 may be used to pressurize the low pressure manifold 502 in manners such as discussed above. In various instances, all of the pressure valves 514*a*-514*l* may be opened prior to, during, or after pressurization of the low pressure manifold 502. In other instances, only those pressure valves 514*a*, 514*l* that are coupled with conduits (e.g., the conduits 540*a*, 540*b*) are opened, whether before, during, or after pressurization of the low pressure manifold 502. Manners in which such couplings may be detected are discussed above, including the use of sensors, such as the sensor 516.

Opening the valves 514*a*-514*l* (or, in some instances, only valves 514*a* and 514*f*) can permit pressurization of the pumps 530*a*, 530*b* via the conduits 540*a*, 540*b*. The pumps 530*a*, 530*b* can permit the pressurization to continue to the inlets 522*a*, 522*c* via the conduits 544*a*, 544*b*. In some instances, as discussed above, the foregoing processes can occur prior to activation of the pumps via their associated prime movers. Fluid that has flowed through the pumps 530*a*, 530*b*, or that has otherwise been pressurized due to the opening of the valves 514*a*, 514*f*, can be blocked by the valves 524*a*, 526*a* and 524*b*, 526*b*. In some instances, all of the high pressure valves 524*a*, 524*b*, 524*c*, 526*a*, 526*b*, 526*c* can be closed prior to pressurization of the pumps 530*a*, 530*b* to maintain pressurization of the conduits 544*a*, 544*b* when the valves 514*a*-514*l* are opened and then subsequently closed.

After the pumps 530*a*, 530*b* and the conduits 540*a*, 540*b*, 544*a*, 544*b* have been pressurized in this manner, the valves 514*a*-514*l* are closed. This traps the pressurized fluid in the conduits 540*a*, 540*b*, 544*a*, 544*b*.

With reference again to FIG. 16, at block 704, either the high pressure plug valves 524*a*, 524*b*, 524*c* or the high pressure bleed valves 526*a*, 526*b*, 526*c* may be opened in a serial fashion. For example, in some embodiments, all of the bleed valves 526*a*, 526*b*, 526*c* are maintained in a closed state while each of the plug valves 524*a*, 524*b*, 524*c* is opened serially. This may permit fluid to flow into the high pressure manifold 504 from the conduits 546*a*, 546*b* at the various stages of the pairing procedure in which the plug valves 524*a*, 524*c* are opened. In other embodiments, all of the plug valves 524*a*, 524*b*, 524*c* are maintained in a closed state while each of the bleed valves 526*a*, 526*b*, 526*c* is opened serially. This may permit fluid to flow into one or more pressure relief conduits (not shown) that are coupled to the bleed ports 527*a*, 527*c* at the various stages of the pairing procedure in which the bleed valves 526*a*, 526*c* are opened.

At block 706, it is determined whether a pressure drop occurs at any of the pumps 530*a*, 530*b* when one of the high pressure valves is opened. Accordingly, in some embodiments, blocks 704 and 706 may be performed simultaneously or in conjunction with each other. If a pressure drop occurs, an association is made between the particular pump at which the pressure drop occurred and the valve that was opened. If no pressure drop occurs, it can be determined that the valve that was opened is not associated with a pump. These associations and lack of associations can be used or recorded to create a flow path definition of the system 500.

By way of illustration, with reference again to FIG. 14, the procedures at blocks 704 and 706 may be carried out as follows. During and after pressurization of the pumps 530*a*, 530*b*, all of the high pressure valves 524*a*-524*c*, 526*a*-526*c* are closed. The plug valve 524*a* is then opened and a pressure drop is sensed at the pump 530*a* (e.g., via any suitable sensor, such as one or more of the sensors 536*a*, 538*a*). From this pressure drop, it is determined that the valve 524*a* is coupled with the pump 530*a*. Moreover, it can also be determined that the valve 526*a* and the inlet 522*a* are coupled with the pump 530*a*. These associations can be recorded in constructing a flow path definition of the system 501. The plug valve 524*a* can then be closed.

The plug valve 524*b* is then opened. No pressure drop is registered at the remaining pump. That is, in some instances, once a pump has been paired, its sensors may no longer be evaluated in subsequent stages of blocks 704 and 706. However, in other instances, the sensors may all be evaluated, regardless of whether or not a particular pump has been paired. In either case, the lack of a pressure drop due to the opening of the valve 524*b* indicates that this valve is not coupled with a pump. This lack of association may be recorded or otherwise identified. Likewise, the lack of association of the valve 526*b* or the inlet 522*b* with a pump may also be recorded or otherwise identified due to the lack of a pressure drop.

The plug valve 524*c* is then opened and a pressure drop is sensed at the pump 530*b*. From this pressure drop, it is determined that the valve 524*c* is coupled with the pump 530*b*. Moreover, it can also be determined that the valve 526*c* and the inlet 522*c* are coupled with the pump 530*b*. These associations can be recorded in constructing a flow path definition of the system 501.

With reference again to FIG. 16, after all of the high pressure valves have been mapped to specific pumps or to no pumps, as the case may be, the method 700 can progress to block 708. At this stage, the low pressure manifold 502 remains pressurized. In some instances, each low pressure valve 514*a*-514*l* is opened in serial fashion. In other instances, only those low pressure valves 514*a*, 514*f* for which it is known that coupling to a conduit is present are opened in serial fashion.

At block 710, it is determined whether a pressure increase occurs at any of the pumps 530*a*, 530*b* when one of the low pressure valves is opened. Accordingly, in some embodiments, blocks 708 and 710 may be performed simultaneously or in conjunction with each other. If a pressure increase occurs, an association is made between the particular pump at which the pressure increase occurred and the low pressure valve that was opened.

By way of illustration, with reference again to FIG. 14, the procedures at blocks 708 and 710 may be carried out as follows. All of the low pressure valves 514*a*-514*l* and all of the high pressure valves 524*a*-524*c*; 526*a*-526*c* are closed. The low pressure valve 514*a* is then opened and a pressure increase is sensed at the pump 530*a* (e.g., via any suitable sensor, such as one or more of the sensors 536*a*, 538*a*). From this pressure increase, it is determined that the valve 514*a* is coupled with the pump 530*a*. The low pressure valve 514*a* can then be closed and pressure bled from the high pressure side.

In some embodiments, each of the remaining valves 514*b*-514*l* are opened and closed in serial fashion to determine whether a pressure increase occurs at the remaining pump 530*b*. In other embodiments, only the remaining valves for which a conduit coupling is present are opened in serial fashion. Accordingly, in the illustrated embodiment, the valve 514*f* is then opened and a pressure increase is sensed at the pump. From this pressure increase, it is determined that the valve 514*f* is coupled with the pump 530*b*. The low pressure valve 514*a* can then be closed and bled.

Although in the foregoing discussion, pressure increases and decreases have been made at the pumps, it should be understood that pressure sensing may be performed at other locations, for example, at the outlets of the low pressure manifold 502, the inlets of the high pressure manifold 504, or at, on, or within the conduits 540*a*, 544*a*, 540*b*, 544*b*.

Much of the foregoing discussion has involved systems and methods for the identification and creation of flow path definitions for a pumping system, such as the pumping system 110 of FIG. 1 and the pumping system 501 of FIG. 14. The flow path definitions can be representations of physical couplings between various pieces of fluid delivery equipment, such as between a missile, or manifold assembly, and a plurality of fracturing pumps. Creation of the flow path definitions can be largely or entirely automated and may involve the use of control systems, as previously discussed. In some embodiments, a user or operator may be capable of manually entering data into the flow path definitions or otherwise editing the flow path definitions. For example, the operator may be capable of editing flow path definitions via a user interface to a computerized system.

The flow path definitions can be used to control the pumping systems 110, 501. For example, the flow path definitions can serve as interlocks or failsafes that can prevent undesired operation of the pumps. Using the flow path definitions, a control system can control the valves, the pumps, or both the valves and the pumps to achieve desired operational conditions for the system and to avoid potentially harmful or damaging operational conditions. For example, the control systems can be configured to prevent pumping of the pumps against closed high pressure valves.

Figure 17:
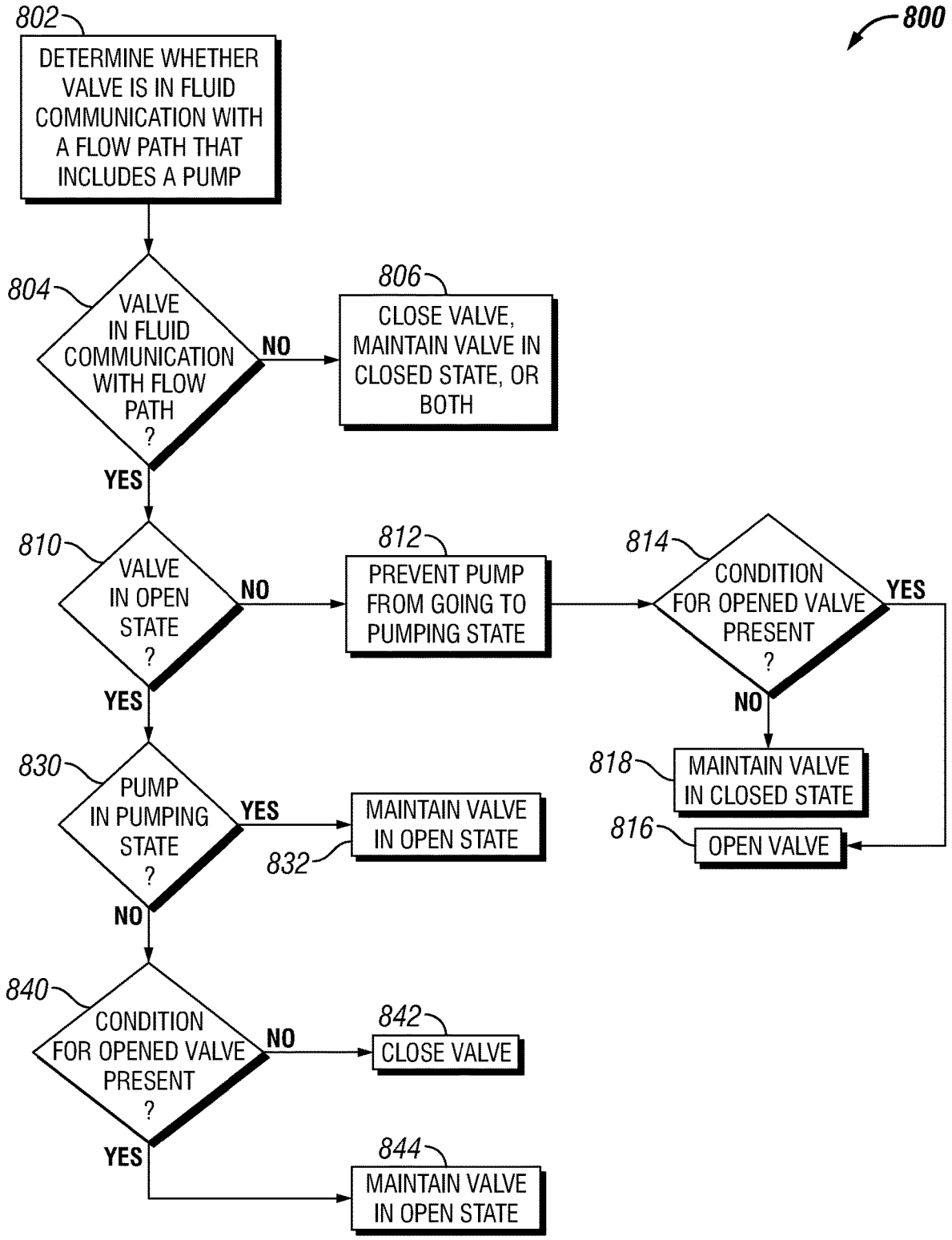
FIG. 17 is a flow chart depicting an example of a method for controlling one or more valves of a manifold system.

FIG. 17 is a flow chart depicting an illustrative method 800 for controlling a pumping system (such as the pumping systems 110, 501), which can include a manifold system that may be used in high pressure fracturing operations. The method 800 may utilize any suitable control system, such as the control systems 125, 270 discussed above. For example, much or all of the method 800 may be automated and may be executed by a processor or the like. For the purposes of the present discussion, specific mention will be made to controls for the pumping system 501 in FIG. 14. These references are merely by way of illustration. It is to be understood that the methods and processes disclosed can be suitably used with a variety of manifold systems and pumps. Moreover, the method may be used with the same manifold and the same or a different set of pumps that are connected in a variety of different configurations.

At action block 802, it is determined whether a particular valve is in fluid communication with a flow path that includes a pump. The valve may, for example, be any of the low pressure valves 514*a*-514*l*, the high pressure plug valves 524*a*-524*c*, or the high pressure bleed valves 526*a*-526*c*. The determination may be made by merely accessing a flow path definition that has previously been determined and/or recorded in a computer readable memory in any suitable manner. For example, the flow path definition may have been previously created and stored by any of the systems and/or processes discussed above with respect to FIGS. 8-16. In other instances, block 802 may comprise executing a program to implement any of the processes discussed above with respect to FIGS. 8-16.

At decision block 804, it is determined whether the valve is in fluid communication with a flow path. For example, it may be determined that the low pressure valve 514*a* is in fluid communication with the flow path 550*a*, which is also coupled with the pump 530*a* and the high pressure valves 524*a*, 526*a*. In another example, it may be determined that the valve 514*b* is not in fluid communication with the flow path 550*a*.

If the valve is not in fluid communication with any flow path, the process can proceed to action block 806. Here, the valve can either be closed, if it is in an open state. The open state may be a fully open or partially open state. If the valve is already in a closed state, it can be maintained in the closed state. Action block 806 can be a failsafe that can aid in ensuring that a valve does not open a pressurized manifold to the environment. For example, block 806 can prevent any of the low pressure valves 514*b*-514*e*, 514*g*-514*l* from being opened to the environment, which could otherwise, in some arrangements, permit pressurized fluid to escape into the environment from the low pressure manifold 502. Similarly, the action at block 806 can prevent the high pressure plug valve 524*b* from opening the high pressure manifold 504 to the environment.

If, on the other hand, the valve is in fluid communication with a flow path, the process can proceed to decision block 810. Here, it is determined whether the valve is in an open state. If the valve is not in an open state, the process can proceed to decision block 812. Here, it is determined whether a pump that is associated with the valve is in a pumping state. That is, the flow path definition for the valve can include information regarding which pump the valve is coupled with. Additional information regarding the pump, such as whether or not it is in a pumping state, can be accessed or provided in any suitable manner. For example, any suitable sensor, switch, or other mechanical, electromechanical, electrical, or other device may be used to provide information to a processor regarding whether a particular pump 530*a*, 530*b* is presently pumping or is presently idle. Accordingly, in some embodiments, at decision block 812, a processor may determine whether a specific pump that is coupled to the valve is presently in a pumping state.

If the pump is not in a pumping state, the process can proceed to decision block 814. Here, it is determined whether a condition for opening the valve is present. Such a condition may be manually entered into the control system, or it may be provided from a set of previously programmed rules. For example, the condition may be an indication that the pump is about to be started. The condition may even be the delivery of a command to start the pump. In such instances, it may be desirable to open a low pressure valve 514 or a high pressure valve 524. If such a condition is present, the valve can be opened at action block 816. If such a condition is not present, the valve can be maintained in a closed state at action block 818.

Returning to decision block 812, if it is found that the pump is in a pumping state and an associated valve is in a closed state, it may be desirable to open the valve. With reference again to FIG. 17, and returning to decision block 810, it may be determined that the valve is in an open state. Whether or not the valve is in an open state may be determined in any suitable manner, such as via the position sensors 266, 274, 278 discussed above. If the valve is in the open state, the process can proceed to decision block 830, at which it is determined whether the pump is in the pumping state. If so, then the valve can be maintained in the open state at action block 832. For example, if the valves 514*a* and 524*a* were each in an open state during a hydraulic fracturing procedure, it may be desirable to maintain these valves in the open state. Maintaining the valve 514*a* in the open state would ensure continued supply of fracturing fluid. Maintaining the valve 524*a* in the open state would prevent pumping high pressure fluid against a closed valve, which could result in undesired consequences.

If the pump is not in the pumping state, the method 800 can proceed to decision block 840, at which it is determined whether a condition for having the valve in an opened state is present. In some instances, there may be few instances where a low pressure valve 514 or a high pressure plug valve 524 should be open when the pump is not in a pumping state. Accordingly, such plugs may desirably be closed at action block 842.

In some situations, it may be desirable to bleed pressure from the fluid conduit 544*a* when the pump 530*a* is not operating. Such a situation may lead to opening the bleed valve 526*a* in the first place, and may serve as a condition for maintaining the bleed valve 526*a* in the open state. In such an example, the process 800 can proceed to action block 844, at which the bleed valve 526*a* is maintained in the open state.

Figure 18:
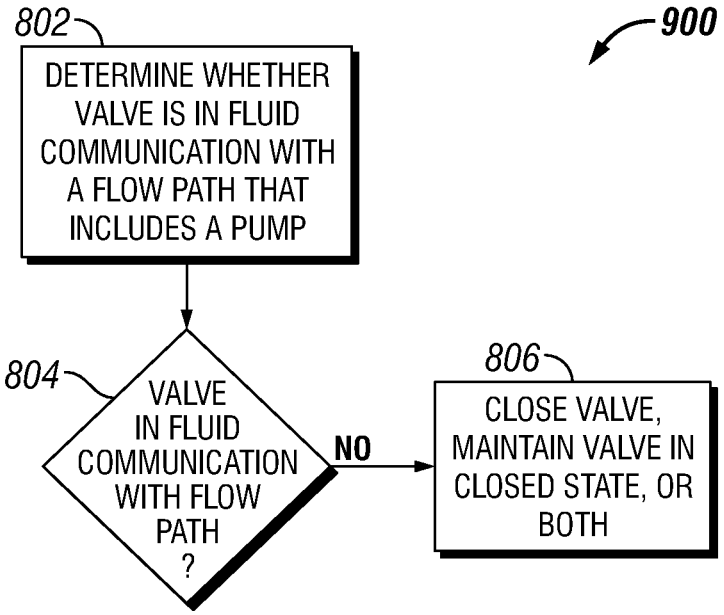
FIG. 18 is a flow chart depicting another example of a method for controlling one or more valves of a manifold system.

FIG. 18 is a flow chart depicting another illustrative method 900 for controlling a pumping system. The method 900 comprises a subset of the method 800, which may constitute a failsafe routine. Specifically, the processes includes blocks 802, 804, and 806 such that, if it is determined that a valve is not in fluid communication with any flow path, a default action thus may be to close a valve or maintain the valve in a closed state.

Figure 19:
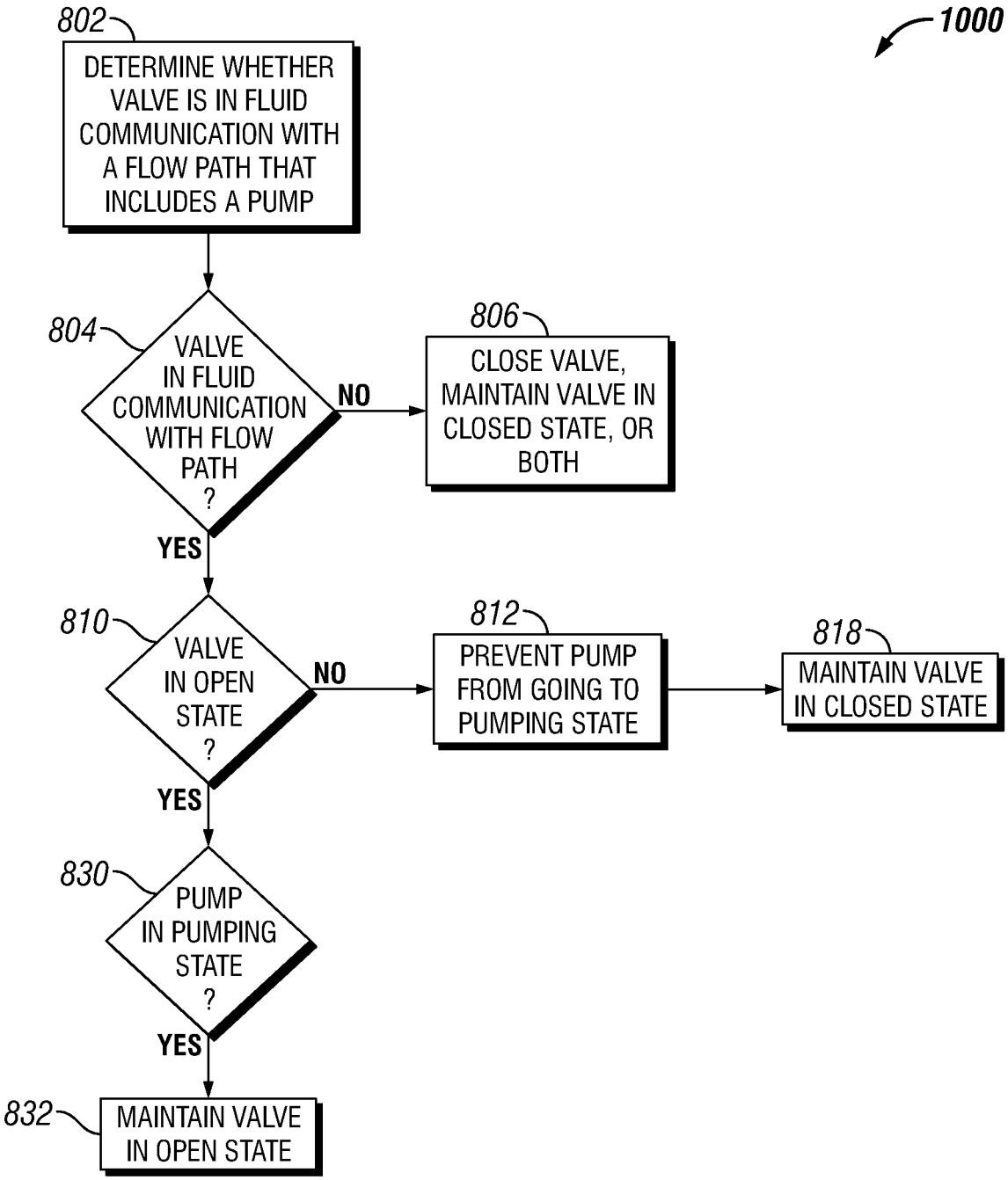
FIG. 19 is a flow chart depicting another example of a method for controlling one or more valves of a manifold system.

FIG. 19 is a flow chart depicting an illustrative method 1000 for controlling a pumping system. The method 1000 comprises a subset of the method 800. In this process, there may not be any conditions under which it is desirable for a particular valve to be open when the pump is not in the pumping state. Accordingly, if the valve is either in the open state or the closed state and the pump is not in the pumping state, the valve is either closed or maintained in the closed state. Thus, method 1000 eliminates the blocks 814, 816, 840, and 842.

Figure 20:
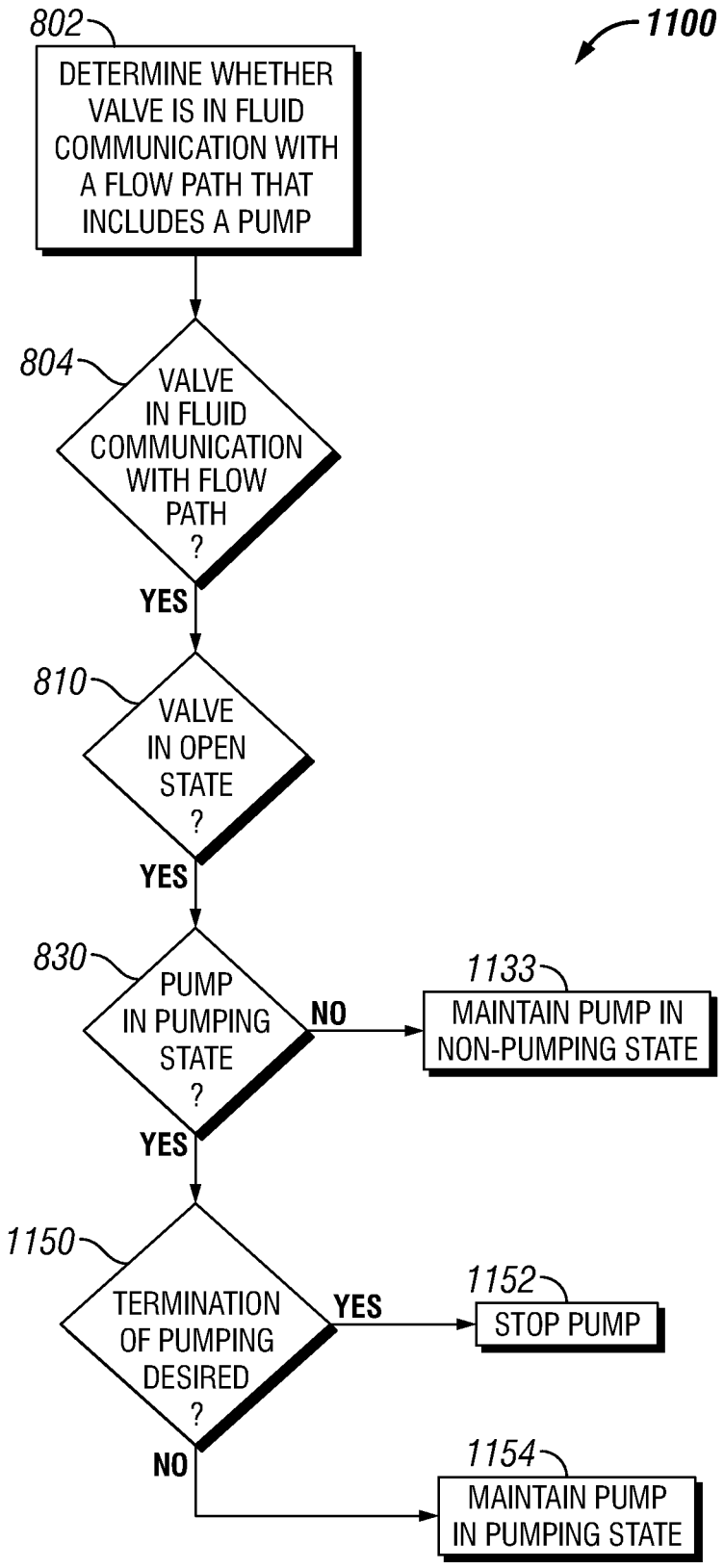
FIG. 20 is a flow chart depicting an example of a method for controlling one or more pumps of a pumping system that includes a manifold.

FIG. 20 is a flow chart depicting another illustrative method 1100 for controlling a pumping system. In particular, the method 1100 includes specific controls for a pump that are based at least in part on a flow path definition. As with prior methods, the flow path definition can either be created or accessed at action block 802. Other portions of the method 1100 that resemble the method 1000 are numbered identically thereto.

The method 1100 includes a failsafe measure at action block 1133, if a particular valve is closed but the pump is in a pumping state, the pump will be stopped. Control of the pump may be achieved in any suitable manner. A control system, such as discussed above, can communicate with the pump and can be configured to turn off the pump in any suitable manner, for example, by activating a kill switch. With reference to FIG. 14, by way of example, if the valve 524*a* were closed, but the pump 530*a* were in a pumping state, the control system could automatically transition the pump 530*a* to a stopped state.

With continued reference to FIG. 20, if the valve is in the open state and the pump is in a pumping state, at decision block 1150 whether the pump should be stopped. If so, the pump is stopped at action block 1152; if not, the pump is permitted to continue pumping at action block 1154.

Figure 21:
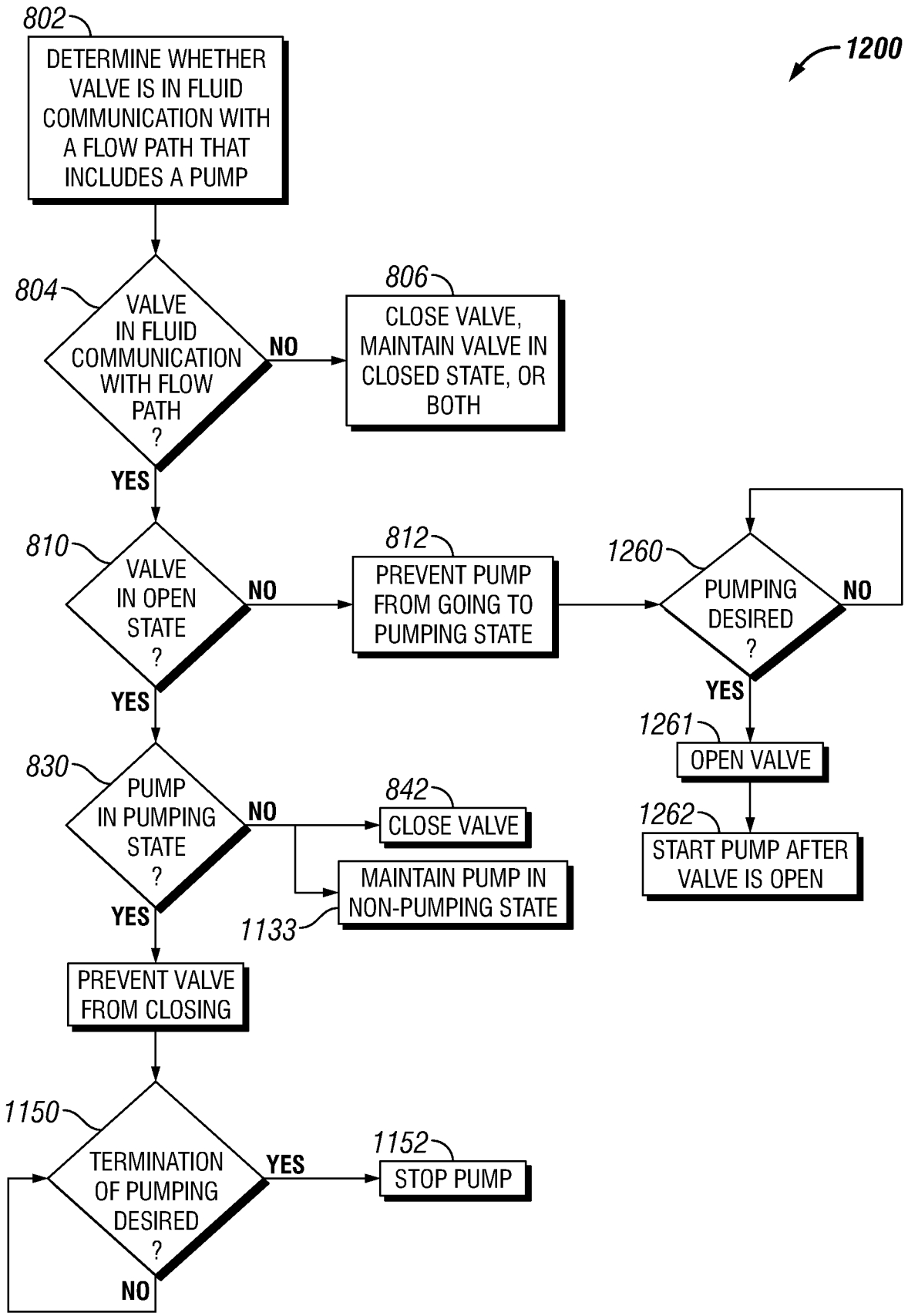
FIG. 21 is a flow chart depicting an example of a method for controlling one or more pumps and one or more valves of a pumping system that includes a manifold.

FIG. 21 is a flow chart depicting another illustrative method 1200 for controlling a pumping system. In particular, the method 1200 includes specific controls for both a pump and a valve that are based at least in part on a flow path definition. The method 1200 includes elements of the methods 800 and 1100, as shown by the numbering employed.

Decision block 1260 is reached if the valve is closed and the pump is not pumping. Here, it is determined whether pumping is desired. If so, then the process proceeds to block 1261 to open the valve before proceeding to block 1262, at which the pump is started (or is permitted to start) after the valve is open. An example of this circumstance might be the valve 524*a*. If this valve is closed and the pump 530*a* is not pumping, it may be desirable to open the valve 524*a* prior to starting the pump 530*a*. In some embodiments, upon determining that the pump remains in pumping state at block 830, the control system will prevent the valve 524*a* from closing in parallel to awaiting an termination of pumping at block 1150.

In the foregoing description of embodiments of the present disclosure, numerous specific details are set forth in order to provide a more thorough understanding of the disclosure. As used herein, "embodiments" refers to non-limiting examples of the application disclosed herein, whether claimed or not, which may be employed or present alone or in any combination or permutation with one or more other embodiments. Each embodiment disclosed herein should be regarded both as an added feature to be used with one or more other embodiments, as well as an alternative to be used separately or in lieu of one or more other embodiments. It should be understood that no limitation of the scope of the claimed subject matter is thereby intended, any alterations and further modifications in the illustrated embodiments, and any further applications of the principles of the application as illustrated therein as would normally occur to one skilled in the art to which the disclosure relates are contemplated herein. In some instances, well-known features have not been described in detail to avoid unnecessarily complicating the description.

Further, any references to "one embodiment" or "an embodiment" mean that a particular element, feature, structure, or characteristic described in connection with the embodiment is included in at least one embodiment. The appearances of the phrase "in one embodiment" in various places in the specification are not necessarily referring to the same embodiment.

As used herein, the term "fluid" includes the ordinary definition of this term, and is inclusive of fracturing fluids or treatment fluids. The term can include liquids, gases, slurries, and combinations thereof, as will be appreciated by those skilled in the art. A treatment fluid may take the form of a solution, an emulsion, slurry, or any other form as will be appreciated by those skilled in the art.

The foregoing discussion has focused on the context of hydraulic fracturing. It should be understood that it is also applicable to other contexts, such as other contexts in which control of valves or pumps against high pressure manifolding may be desired.

The invention claimed is:

1. A system, comprising:

a low pressure manifold comprising an inlet and an outlet;

a high pressure manifold comprising an inlet and an outlet;

a flow path comprising the low pressure manifold outlet and the high pressure manifold inlet;

a pump that comprises a portion of the flow path;

a valve coupled with one of the low pressure and the high pressure manifolds; and a control system coupled with the valve and the pump and comprising an actuator coupled to the valve, wherein the control system comprises a processor that is configured to:

determine whether the valve is in fluid communication with the flow path, wherein the control system controls the valve, the pump, or both based on the determination;

control the valve via the actuator;

receive data representing an operational state of the pump, wherein the control of at least one of the valve and the pump is further based on the data representing the operational state of the pump; and receive data representing an operational state of the valve, wherein the control of at least one of the valve and the pump is further based on the data representing the operational state of the valve;

wherein when the determination is that the valve is in fluid communication with the flow path, the pump is in a non-pumping state, and the valve is in a closed state, the valve is controlled by the processor by opening the valve, and the pump is controlled by the processor by transitioning the pump to a pumping state after the valve has been opened.

2. The system of claim 1, wherein the outlet of the high pressure manifold is in fluid communication with a wellbore.

3. The system of claim 1, wherein the inlet of the low pressure manifold is in fluid communication with a blender.

4. The system of claim 1, wherein when the determination that is made by the processor is that the valve is not in fluid communication with the flow path, the valve is controlled by the processor by at least one of closing the valve and maintaining the valve in a closed state.

5. The system of claim 4, wherein the valve is directly connected to one of the inlets of the high pressure manifold.

6. The system of claim 4, wherein the valve comprises one of an isolation valve and a bleed valve.

7. The system of claim 1, wherein the valve, the pump, or both is controlled based on a command to start pumping.

8. The system of claim 1, wherein when the determination is that the valve is in fluid communication with the flow path, the pump is in a pumping state, and the valve is in an open state, the pump is controlled by the processor by transitioning the pump to a non-pumping state.

9. The system of claim 1, wherein the flow path extends from the low pressure manifold to the high pressure manifold, and wherein, when the pump is in a pumping mode, fluid flow is permitted from the low pressure manifold through said one of the outlets of the low pressure manifold, through the pump, and through said one of the inlets of the high pressure manifold into the high pressure manifold.

10. The system of claim 1, wherein the control system is coupled with the valve and the pump via a network.

11. The system of claim 1, wherein the processor is configured to execute computer readable instructions to make the determination and to control at least one of the valve and the pump.

12. The system of claim 1, wherein the processor is configured to make the determination by accessing a flow path definition that is representative of the flow path, wherein the flow path definition is stored in a non-transitory computer readable medium.

13. The system of claim 12, wherein the control system further comprises the non-transitory computer readable medium.

14. The system of claim 12, wherein the processor is further configured to create the flow path definition and store the flow path definition in the non-transitory computer readable medium.

15. The system of claim 12, wherein the flow path definition comprises a representation of said one of the outlets of the low pressure manifold being in fluid communication with the pump and further comprises a representation of the pump being in fluid communication with said one of the inlets of the high pressure manifold.

16. The system of claim 15, wherein the flow path definition further comprises a representation of the valve being coupled to one of said one of the outlets of the low pressure manifold and said one of the inlets of the high pressure manifold.

17. The system of claim 1, wherein the processor is configured to make the determination by creating a flow path definition that is representative of the flow path.

18. The system of claim 1, wherein the control system further comprises a sensor for obtaining data from which the processor can make the determination of whether the valve is in fluid communication with the flow path.

19. The system of claim 18, wherein the sensor comprises one of an image sensor, an optical receiver, an electrical connector, and a pressure transducer.

20. The system of claim 18, wherein the sensor is coupled to said one of the inlets of the high pressure manifold, and wherein the sensor is configured to sense whether a conduit is coupled to said one of the inlets.

21. The system of claim 18, wherein the processor is configured to make the determination of whether the valve is in fluid communication with the flow path based at least in part on information provided by the sensor.

22. The system of claim 1, wherein the flow path comprises a first conduit that provides fluid communication between said one of the outlets of the low pressure manifold and the pump and comprises a second conduit that provides fluid communication between the pump and said one of the inlets of the high pressure manifold.

23. The system of claim 22, wherein the second conduit comprises steel piping.

24. The system of claim 1, wherein the system is disposed on a trailer for transportation to a job site.

25. A system for treating a subterranean formation, comprising:

a low pressure manifold that comprises an inlet and a plurality of outlets;

a high pressure manifold that comprises a plurality of inlets and an outlet;

a valve coupled with one of (a) one of the plurality of outlets of the low pressure manifold and (b) one of the plurality of inlets of the high pressure manifold;

a pump in fluid communication with the valve, wherein the pump comprises a portion of a flow path, wherein the flow path comprises a specific one of the outlets of the low pressure manifold and a specific one of the inlets of the high pressure manifold, and wherein the valve is coupled with one of said specific outlet of the low pressure manifold and said inlet of the high pressure manifold; and a control system coupled to the valve and the pump, wherein the control system comprises a processor that is configured to:

determine whether the valve is in fluid communication with the flow path;

control the valve based on the determination; and control at least one of the pump and the valve based on data representing an operational state of the pump and based on data representing an operational state of the valve, wherein the control of at least one of the pump and the valve, when the pump is in a non-pumping state and the valve is in a closed state, comprises opening the valve and transitioning the pump to a pumping state.

26. The system of claim 25, wherein the control system further comprises an actuator coupled with the valve, and wherein the processor is configured to control the valve via the actuator.

27. The system of claim 25, wherein the control of at least one of the pump and the valve, when the pump is in a pumping state and the valve is in an open state, comprises maintaining the valve in the open state.

28. The system of claim 25, wherein the control of at least one of the pump and the valve, when the pump is in a non-pumping state and the valve is in a closed state, comprises maintaining the pump in the non-pumping state.

29. The system of claim 25, wherein the valve is coupled with the specific inlet of the high pressure manifold.

30. The system of claim 25, wherein the control system further comprises a sensor for obtaining data from which the processor can make the determination of whether the valve is in fluid communication with the flow path.

31. The system of claim 25, wherein the system is disposed on a trailer for transportation to a job site.

32. A system for treating a subterranean formation, comprising:

a low pressure manifold comprising a plurality of inlets and a plurality of outlets;

a high pressure manifold comprising a plurality of inlets and an outlet in fluid communication with a wellbore;

a plurality of valves coupled with each of the inlets of the high pressure manifold;

a plurality of pumps, each of the pumps comprising an inlet in fluid communication with an outlet of the low pressure manifold outlet and each of the pumps comprising an outlet in fluid communication with an inlet of the high pressure manifold; and a control system comprising a processor that is coupled to the pumps and to the valves, wherein the processor is configured to:

receive data representing the fluid communication between the pump outlets and the high pressure manifold inlets;

receive data representing an operational state of the pumps;

receive data representing an operational state of the valves; and open and close the valves based on the fluid communication between the pump outlets and the data of the high pressure manifold inlets and the data of the operational state of the pumps;

wherein the control system is coupled with the pumps and is configured to control the pumps, and wherein when the valves are in a closed state and the pumps are in a non-pumping state, control of the pumps comprises maintaining the pumps in the non-pumping state.

33. The system of claim 32, wherein the control system comprises at least one sensor coupled to an inlet of the high pressure manifold that is configured to sense whether a conduit is coupled to an inlet of the high pressure manifold.

34. The system of claim 33, wherein at least a portion of the data representing the fluid communication between the outlet of the pump and the inlet of the high pressure manifold is provided by the sensor.

35. The system of claim 32, wherein the control system further comprises at least one sensor for obtaining the data representing the fluid communication between an outlet of the pump and an inlet of the high pressure manifold.

36. The system of claim 35, wherein the sensor comprises one of an image sensor, an optical receiver, an electrical connector, and a pressure transducer.

37. The system of claim 32, wherein the data representing the fluid communication between the outlet of the pump and the inlet of the high pressure manifold is stored in a non-transitory computer readable medium.

38. The system of claim 37, wherein the control system further comprises the non-transitory computer readable medium.

39. The system of claim 32, wherein the control system is coupled with the pumps, and wherein the processor is configured to receive from the pumps the data representing the operational state of the pumps.

40. The system of claim 32, wherein control of the valves comprises maintaining the valves in an open state when the pumps are in a pumping state.

41. A method, comprising:

identifying at least one flow path, via a processor, the flow path extending between a low pressure manifold and a high pressure manifold, the low pressure manifold comprising an inlet and a plurality of outlets, the high pressure manifold comprising a plurality of inlets and an outlet, wherein the low pressure manifold and the high pressure manifold define a plurality of flow paths therebetween, and wherein each of the flow paths comprise at least one pump;

making a determination, via the processor, as to whether a valve is in fluid communication with the identified flow path;

controlling the valve via the processor based on the determination;

receiving, via the processor, data representing an operational state of the pump and data representing an operational state of the valve; and controlling operation of the at least one pump via the processor based on the data representing the operational state of the pump and the data representing the operational state of the valve, wherein when the valve is in a closed state and the pump is in a non-pumping state, the controlling operation of the pump comprises maintaining the pump in the non-pumping state.

42. The method of claim 41, wherein when the determination is that the valve is not in fluid communication with the flow path, said controlling the valve comprises at least one of closing the valve and maintaining the valve in a closed state.

43. The method of claim 41, wherein the outlet of the high pressure manifold is in fluid communication with a wellbore.

44. The method of claim 41, wherein identifying comprises accessing a flow path definition that is representative of the flow path from a non-transitory computer readable medium.

45. The method of claim 41, wherein identifying comprises creating a flow path definition that is representative of the flow path via the processor.

46. The method of claim 41, further comprising receiving, via the processor, data representing an operational state of the valve, wherein said controlling the valve via the processor is further based on the date representing the operational state of the valve.

47. The method of claim 41, further comprising receiving, via the processor, data representing an operational state of the pump and data representing an operational state of the valve, wherein said controlling the valve via the processor is further based on the data representing the operational state of the pump and the data representing the operational state of the valve.

48. The method of claim 47, wherein when the valve is in an open state and the pump is in a pumping state, said controlling operation of the valve comprises maintaining the valve in the open state.

49. A system, comprising:

a low pressure manifold comprising an inlet and an outlet;

a high pressure manifold comprising an inlet and an outlet;

a flow path comprising the low pressure manifold outlet and the high pressure manifold inlet;

a pump that comprises a portion of the flow path;

a valve coupled with one of the low pressure and the high pressure manifolds; and a control system coupled with the valve and the pump and comprising an actuator coupled to the valve, wherein the control system comprises a processor that is configured to:

determine whether the valve is in fluid communication with the flow path, wherein the control system controls the valve, the pump, or both based on the determination;

control the valve via the actuator;

receive data representing an operational state of the pump, wherein the control of at least one of the valve and the pump is further based on the data representing the operational state of the pump; and receive data representing an operational state of the valve, wherein the control of at least one of the valve and the pump is further based on the data representing the operational state of the valve;

wherein when the determination is that the valve is in fluid communication with the flow path, the pump is in a pumping state, and the valve is in an open state: the pump is controlled by the processor by transitioning the pump to a non-pumping state.

50. A system for treating a subterranean formation, comprising:

a low pressure manifold that comprises an inlet and a plurality of outlets;

a high pressure manifold that comprises a plurality of inlets and an outlet;

a valve coupled with one of (a) one of the plurality of outlets of the low pressure manifold and (b) one of the plurality of inlets of the high pressure manifold; and a pump in fluid communication with the valve, wherein the pump comprises a portion of a flow path, wherein the flow path comprises a specific one of the outlets of the low pressure manifold and a specific one of the inlets of the high pressure manifold, and wherein the valve is coupled with one of said specific outlet of the low pressure manifold and said inlet of the high pressure manifold; and a control system coupled to the valve and the pump, wherein the control system comprises a processor that is configured to:

determine whether the valve is in fluid communication with the flow path;

control the valve based on the determination; and control at least one of the pump and the valve based on data representing an operational state of the pump and based on data representing an operational state of the valve, wherein the control of at least one of the pump and the valve, when the pump is in a non-pumping state and the valve is in a closed state, comprises maintaining the pump in the non-pumping state.

* * * * *